US007390607B2

(12) United States Patent
Tanaka et al.

(10) Patent No.: US 7,390,607 B2
(45) Date of Patent: Jun. 24, 2008

(54) TONER, PRODUCTION PROCESS FOR THE SAME, AND IMAGE FORMING METHOD

(75) Inventors: Chiaki Tanaka, Izunokuni (JP); Masayuki Ishii, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/484,565

(22) Filed: Jul. 12, 2006

(65) Prior Publication Data

US 2007/0020548 A1 Jan. 25, 2007

(30) Foreign Application Priority Data

Jul. 13, 2005 (JP) ..... 2005-204898

(51) Int. Cl.
*G03G 5/00* (2006.01)

(52) U.S. Cl. ..... 430/137.15; 430/137.14; 430/137.1; 430/124.1; 430/109.1

(58) Field of Classification Search ..... 430/137.15, 430/137.14, 137.1, 124.1, 109.1
See application file for complete search history.

(56) References Cited

U.S. PATENT DOCUMENTS

| | | | | |
|---|---|---|---|---|
| 5,344,985 | A | 9/1994 | Tanaka et al. | |
| 5,457,232 | A | 10/1995 | Tanaka et al. | |
| 5,459,275 | A | 10/1995 | Tanaka et al. | |
| 5,552,502 | A * | 9/1996 | Odell et al. | 526/234 |
| 5,576,132 | A | 11/1996 | Tanaka et al. | |
| 5,587,516 | A | 12/1996 | Tanaka et al. | |
| 5,599,995 | A | 2/1997 | Tanaka et al. | |
| 5,616,805 | A | 4/1997 | Tanaka et al. | |
| 5,672,728 | A | 9/1997 | Tanaka et al. | |
| 5,688,870 | A * | 11/1997 | Wilkinson et al. | 525/244 |
| 5,976,746 | A | 11/1999 | Tanaka et al. | |
| 6,066,428 | A | 5/2000 | Katayama et al. | |
| 6,172,176 | B1 | 1/2001 | Tanaka et al. | |
| 6,194,535 | B1 | 2/2001 | Katayama et al. | |
| 6,465,648 | B1 | 10/2002 | Tadokoro et al. | |
| 6,512,062 | B1 | 1/2003 | DeSimone et al. | |
| 6,544,701 | B2 | 4/2003 | Tadokoro et al. | |
| 6,548,216 | B2 | 4/2003 | Kawamura et al. | |
| 6,974,654 | B2 | 12/2005 | Kawamura et al. | |
| 7,056,633 | B2 | 6/2006 | Kawamura et al. | |
| 2001/0036586 | A1 | 11/2001 | Adachi et al. | |

(Continued)

FOREIGN PATENT DOCUMENTS

EP 1 296 201 A1 3/2003

(Continued)

OTHER PUBLICATIONS

U.S. Appl. No. 11/520,642, filed Sep. 14, 2006, Tanaka, et al.

(Continued)

*Primary Examiner*—Mark A Chapman
(74) *Attorney, Agent, or Firm*—Oblon, Spivak, McClelland, Maier & Neustadt, P.C.

(57) ABSTRACT

To provide a toner production process in which at least radically polymerizable monomers are polymerized in at least one of a supercritical fluid and a subcritical fluid to thereby produce toner particles, wherein a polymer of the radically polymerizable monomers is insoluble in at least one of the supercritical fluid and the subcritical fluid.

14 Claims, 5 Drawing Sheets

U.S. PATENT DOCUMENTS

| | | | |
|---|---|---|---|
| 2004/0053152 | A1 | 3/2004 | Nagai et al. |
| 2004/0265721 | A1 | 12/2004 | Matsuoka et al. |
| 2006/0035161 | A1 | 2/2006 | Kawamura et al. |
| 2006/0068313 | A1 | 3/2006 | Nakayama et al. |

FOREIGN PATENT DOCUMENTS

| | | |
|---|---|---|
| JP | 5-66600 | 3/1993 |
| JP | 8-211655 | 8/1996 |
| JP | 3141783 | 12/2000 |
| JP | 2001-312098 | 11/2001 |
| JP | 2004-144778 | 5/2004 |
| JP | 2004-161824 | 6/2004 |
| JP | 2005-107405 | 4/2005 |
| JP | 2005-266620 | 9/2005 |
| JP | 2005-266733 | 9/2005 |
| JP | 2005-301250 | 10/2005 |
| JP | 2006-3513 | 1/2006 |
| JP | 2006-30981 | 2/2006 |
| JP | 2006-77219 | 3/2006 |
| JP | 2006-78895 | 3/2006 |
| JP | 2006-111720 | 4/2006 |

OTHER PUBLICATIONS

U.S. Appl. No. 11/522,936, filed Sep. 19, 2006, Ishii, et al.

J. M. DeSimone, et al., "Dispersion Polymerizations in Supercritical Carbon Dioxide", vol. 265, XP-002402031, Jul. 15, 1994, pp. 356-359.

* cited by examiner

TONER, PRODUCTION PROCESS FOR THE SAME, AND IMAGE FORMING METHOD

BACKGROUND OF THE INVENTION

1. Field of the Invention

The present invention relates to a toner suitable for electrophotography, electrostatic recording, electrostatic printing and the like, to an efficient production process for the same, and to an image forming method using the toner.

2. Description of the Related Art

Image forming based on electrophotography generally involves a series of the following individual steps: a latent electrostatic image formation step in which using a variety of means a latent electrostatic image is formed on a photosensitive layer having photoconductive substances; a developing step in which the formed latent electrostatic image is developed by application with toner to form a toner image; a transferring step in which the toner image is transferred to a recording member such as paper; a fixing step in which the toner image transferred to the recording member is fixed thereto by applying heat, pressure, heat/pressure, or solvent's vapor; and a cleaning step in which toner particles remained with the photosensitive layer are removed, for example.

It is required that toners for electrophotography be produced by more energy-saving, environment-friendly processes. The conventional method of kneading and pulverization is employed in current toner production processes.

In such toner production processes that use the kneading and pulverization method, how uniformly each constituent material is dispersed and pulverized is important to ensure that the resultant toner particles have uniform shapes. In general, toner particles have amorphous shapes with randomly-sized cross sections, and control of the shape or structure of toner particles become very difficult. Moreover, when coloring materials, releasing agents, charge-controlling agents and the like are added to the toner, these additives tend to migrate to the surfaces of toner particles during a pulverization process because they cleavage along their crystal plane, resulting in a problem that toner characteristics (e.g., flowability and charging properties) may be reduced. e.g., variations may occur in the charging properties among individual toner particles.

Thus, in recent years, liquid media-based chemical methods (polymerization methods such as emulsion polymerization method, suspension polymerization method, dispersion polymerization method, dissolution and suspension method, and dissolution, suspension and extension method) have been used in most cases for the production of toners.

In the suspension polymerization method, toner materials containing monomers, a polymerization initiator and the like are dispersed in an aqueous medium to form oil droplets, followed by heat treatment to cause a polymerization reaction to take place for the production of toner.

In the emulsion polymerization method, toner materials containing polymers and the like are mixed with an aqueous medium to form oil droplets by allowing the toner materials to be dispersed or emulsified in or with the aqueous medium for the production of toner (see Japanese Patent Application Laid-Open (JP-A) No.05-66600 and 08-211655).

The dissolution and suspension method is disclosed in Japanese Patent (JP-B) No.3141783, for example.

In view of recent environmental problems, as chemical toners produced through these chemical methods (polymerization methods), chemical toners termed as "capsule toner", "core shell toner", etc. are available that are provided in a form that makes efficient provision of desired functions possible.

Toner production processes that involve any of the foregoing polymerization methods can produce spherical toner particles that have smaller diameters and a narrower particle size distribution than those produced by toner production processes involving the pulverization method; however, it is difficult to form droplets of desired shape in the dispersion medium, the range of choice of available materials is small, and variations occur in the charging properties among individual toner particles due to variations in the toner constituting materials. In addition, delicate controlling of the degree of emulsification is required for each color toner, resulting in poor robustness in toner production.

The most challenging problem is that toner surface becomes hydrophilic because toner is produced either in water or hydrophilic medium, reducing charging properties of toner particles and environmental characteristics with time. This may cause such problems as abnormal development and transfer operations, toner splashes, or poor image quality.

Moreover, the polymerized toners described above have a basic problem that the production process thereof entails generation of a large amount of waste solution and requires a large amount of energy for drying of produced toner particles. This may potentially increases the production costs. For this reason, an environment-friendly toner production process has been sought after in view of pollution of water resources and generation of carbon dioxide.

As a toner production process using a supercritical fluid, for example, Japanese Patent Application (JP-A) No.2001-312098 proposes a method for producing toner particles using RESS (Rapid Expansion of Supercritical Solutions) technique. This technique, however, is applicable to only resin that can be dissolved in supercritical fluids, and provides a narrow range of choice of applicable resins. For example, the solubilities of high-molecular weight ingredients or gels (called H body) needed in the toner are of extremely low solubility. In addition, inexpensive and potent styrene-acrylic resins and polyester resins that are generally used in the toner field are also of extremely low solubility. Thus, there is a problem that they cannot be used as they are.

To solve the foregoing problems Japanese Patent Application (JP-A) No.2004-161824, 2004-144778 and 2005-107405 propose a technique in which rather than dissolving resin in a supercritical fluid, colored resin that has been previously melted and kneaded is granulated by application of shearing force using a dispersing agent. This technology has a problem that it broadens the particle size distribution, though a wide range is ensured for the choice of materials. In particular, broader particle distributions are a critical drawback for obtaining high-resolution images as required by recent toners.

No toner production process has been provided that ensures a sharp particle size distribution and excellent toner characteristics (e.g., charging properties, environmental impact, and temporal stability), creates little waste solution, produces toner containing no monomers left over, and requires no drying process. Likewise, neither a toner produced by this toner production process nor an image forming apparatus using the toner have been provided.

SUMMARY OF THE INVENTION

It is an object of the present invention to provide a low-cost, environment-friendly toner production process that ensures a sharp particle size distribution and excellent toner characteristics (e.g., charging properties, environmental impact, and temporal stability), creates little waste solution, requires no drying process, and generates no monomers left over, by producing a chemical toner (polymerized toner) in at least one of a supercritical fluid and a subcritical fluid; a toner produced by the toner production process; and an image forming method capable of increasing the quality of images by the use of the toner.

In order to solve the foregoing problems, the present inventors have extensively conducted studies to provide a toner production process that produces a toner with excellent toner characteristics, creates little waste solution, and requires little drying energy. As a result, they established that a chemical toner (polymerized toner) produced by polymerization of at least polymerizable monomers in at least one of a supercritical fluid and a subcritical fluid rather than in a conventional aqueous or hydrophilic solvent has excellent toner characteristics (e.g., charging properties, environmental impact, and temporal stability), low cost, and environment friendly. Moreover, they established that since supercritical carbon dioxide is a nonflammable, highly safe non-aqueous medium, it is possible to produce a polymerized toner with hydrophobic surfaces, that supercritical carbon dioxide can be readily recycled for reuse because it turns into gas when brought to normal pressure, and that no drying process is required for the resultant toner.

Furthermore, the present inventors established that it is possible to achieve high-yield production of toner with a sharper particle size distribution than conventional toner and to provide high-definition images, by tactfully utilizing the fact that a polymer (resin) produced by polymerization of radically polymerizable monomers in at least one of a supercritical fluid and a subcritical fluid is insoluble in the supercritical and/or subcritical fluid. Moreover, they established that since radically polymerizable monomers are used instead of resin as starting material, it is possible to achieve significant cost reduction by reducing material costs and the number of steps in the toner production process.

The first embodiment of the toner production process of the present invention includes a step in which at least radically polymerizable monomers are polymerized in at least one of a supercritical fluid and a subcritical fluid to thereby produce toner particles, wherein a polymer resulted from the radically polymerizable monomers is insoluble in at least one of the supercritical fluid and the subcritical fluid.

The second embodiment of the toner production process of the present invention includes a step in which at least radically polymerizable monomers are polymerized by dispersion polymerization in at least one of a supercritical fluid and a subcritical fluid to thereby produce toner particles, wherein a polymer resulted from the radically polymerizable monomers is insoluble in at least one of the supercritical fluid and the subcritical fluid.

The third embodiment of the toner production process of the present invention includes a step in which at least radically polymerizable monomers are polymerized by suspension polymerization in at least one of a supercritical fluid and a subcritical fluid to thereby produce toner particles, wherein a polymer resulted from the radically polymerizable monomers is insoluble in at least one of the supercritical fluid and the subcritical fluid.

The fourth embodiment of the toner production process of the present invention includes a step in which at least radically polymerizable monomers are polymerized in at least one of a supercritical fluid and a subcritical fluid and the resultant resin particles are coagulated or aggregated together to produce toner particles, wherein the resin particles (polymer) are insoluble in at least one of the supercritical fluid and the subcritical fluid.

In the toner production process according to any one of the first to fourth embodiments, at least one of a supercritical fluid and a subcritical fluid is used in stead of an aqueous medium, and polymerization of radically polymerizable monomers and production of toner particles are conducted in at least one of a supercritical fluid and a subcritical fluid. Thus, it is possible to efficiently produce a low-cost, environment-friendly toner having a sharp particle size distribution and excellent toner characteristics (e.g., charging properties).

Because the toner of the present invention is produced by the toner production process according to any one of the first to fourth embodiments of the present invention, it has a sharp particle size distribution and excellent toner characteristics (e.g., charging properties, environmental impact, and temporal stability).

The image forming method of the present invention includes at least a latent electrostatic image formation step of forming a latent electrostatic image on a latent electrostatic image bearing member; a developing step of developing the latent electrostatic image using the toner of the present invention to form a visible image; a transferring step of transferring the visible image onto a recording medium; and a fixing step of fixing the transferred visible image transferred to the recording medium. In the latent electrostatic image formation step a latent electrostatic image is formed on a latent electrostatic image bearing member. In the developing step the latent electrostatic image is developed by the toner of the present invention to form a visible image. In the transferring step the visible image is transferred onto a recording medium. In the fixing step the visible image is fixed to the recording medium. As a result, a high-quality, high-definition image is obtained.

Figure 1:
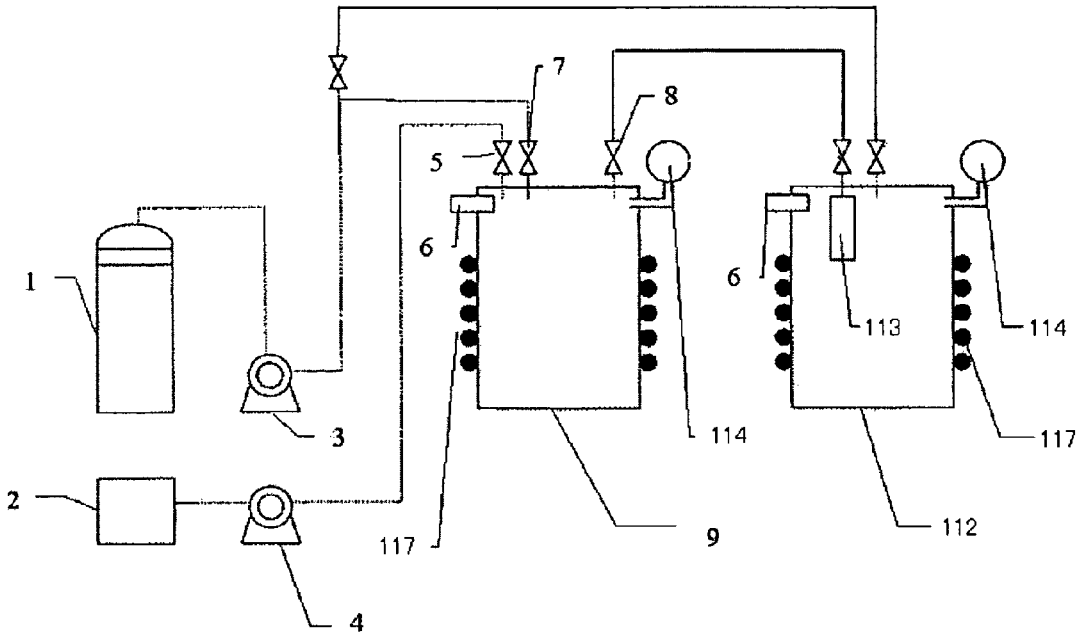
FIG. 1 is a schematic view of an example of a polymerization apparatus employed in the polymerization step of the present invention.

DESCRIPTION OF THE PREFERRED EMBODIMENTS (Toner and Toner Production Process)

The first embodiment of the toner production process of the present invention includes a step in which at least radically polymerizable monomers are polymerized in at least one of a supercritical fluid and a subcritical fluid to thereby produce toner particles, and further includes additional step(s) as needed, wherein a polymer resulted from the radically polymerizable monomers is insoluble in at least one of the supercritical fluid and the subcritical fluid.

The second embodiment of the toner production process of the present invention includes a step in which at least radically polymerizable monomers are polymerized by dispersion polymerization in at least one of a supercritical fluid and a subcritical fluid to thereby produce toner particles, and further includes additional step(s) as needed, wherein a polymer resulted from the radically polymerizable monomers is insoluble in at least one of the supercritical fluid and the subcritical fluid.

The third embodiment of the toner production process of the present invention includes a step in which at least radically polymerizable monomers are polymerized by suspension polymerization in at least one of a supercritical fluid and a subcritical fluid to thereby produce toner particles, and further includes additional step(s) as needed, wherein a polymer resulted from the radically polymerizable monomers is insoluble in at least one of the supercritical fluid and the subcritical fluid.

The fourth embodiment of the toner production process of the present invention includes a step in which at least radically polymerizable monomers are polymerized in at least one of a supercritical fluid and a subcritical fluid and the resultant resin particles are coagulated or aggregated together to produce toner particles, and further includes additional step(s) as needed, wherein the resin particles (polymer) are insoluble in at least one of the supercritical fluid and the subcritical fluid.

It is preferable that in the toner production process according to any one of the first to fourth embodiments the radically polymeriable monomers be insoluble in at least one of the supercritical fluid and subcritical fluid.

The toner of the present invention is produced by the toner production process according to any one of the first to fourth embodiments of the present invention.

Hereinafter, details of the toner of the present invention will be described by describing the toner production process of the present invention.

Herein, "the radically polymerizable monomers are soluble in (compatible with) at least one of the supercritical fluid and the subcritical fluid" means that solution, a mixture of test material (1 g of the radically polymerizable monomers) and at least one of the supercritical fluid and the subcritical fluid which has been placed and agitated in a high-pressure vessel (inner volume: 50 ml) with an inspection window for a given period of time (e.g., 30 minutes), is not cloudy or no phase separation is enacted when seen through the inspection window.

In addition, "the polymer is insoluble in (incompatible with) at least one of the supercritical fluid and the subcritical fluid" means that solution, a mixture of test material (1 g of the polymer) and at least one of the supercritical fluid and the subcritical fluid which has been placed and agitated in a high-pressure vessel (inner volume: 50 ml) with an inspection window for a given period of time (e.g., 30 minutes), is cloudy or phase separation is enacted when seen through the inspection window.

<Toner Particle Production Step>

The step in which polymerizable monomers are polymerized to produce toner particles is one in which resin particles, obtained by polymerization, dispersion polymerization, or suspension polymerization of at least polymerizable monomers in at least one of a supercritical fluid and a subcritical fluid, are coagulated or aggregated together to produce toner particles.

The radically polymerizable monomers are not particularly limited and can be appropriately selected as long as high-molecular weight ingredients resulted from polymerization are resin that can be used for the formation of images as toner binder resin. Examples include polymerizable monomers with unsaturated double bonds, such as vinyl monomers and styrene monomers. Various radically polymerizable monomers are commercially available.

-Supercritical Fluids and Subcritical Fluids-

Supercritical fluids means fluids with properties intermediate between those of gases and liquids, featuring rapid heat and/or substance transfer and low viscosity; their density, permittivity, solubility parameters, free volume, etc. can be sequentially changed by large amounts by changing temperature and/or pressure. In addition, supercritical fluids have much smaller surface tension than organic solvents, filling microscopic asperities on a surface and wetting the surface.

The supercritical fluid is not particularly limited and can be appropriately selected depending on the intended purpose, as long as it exists as a non-compressible, high-density fluid above its critical temperature and critical pressure (critical points) where gas and liquid can co-exist, exists at or above its critical temperature and critical pressure and will never be condensed even when compressed. However, those with low critical temperature and low critical pressure are preferable. In addition, the subcritical fluid is not particularly limited and can be appropriately selected depending on the intended purpose, as long as it exists as a high-pressure liquid at points close to its critical temperature and critical pressure.

Suitable examples of the supercritical fluid and subcritical fluid include carbon monoxide, carbon dioxide, ammonia, nitrogen, water, methanol, ethanol, ethane, propane, 2,3-dimethylbutane, benzene, chlorotrifluoromethane, and dimethylether. Among these, carbon dioxide is most preferable for the following reasons: Carbon dioxide can be readily converted to a supercritical state because it has a critical pressure of as low as 7.3 MPa and a critical temperature of as low as 31° C. Supercritical carbon dioxide is a nonflammable, highly safe non-aqueous medium, which is capable of producing a polymerized toner with hydrophobic surfaces. In addition, supercritical carbon dioxide can be readily recycled for reuse because it turns into gas when brought to normal pressure, no drying process is required for the resultant toner, no waste solution is generated, and the toner contains no monomers left over.

The supercritical fluid or subcritical fluid may be used singly or in combination as a mixture.

The critical temperature and critical pressure of the supercritical fluid are not particularly limited and can be appropriately determined depending on the intended purpose. The critical temperature preferably ranges from −273° C. to 300° C., more preferably from 0° C. to 200° C. The lower the critical pressure, the more advantageous in terms of, for example, loads on apparatus, equipment costs, and operation energy. As a matter of practice, critical pressure preferably ranges from 1 MPa to 100 MPa, more preferably from 1 MPa to 50 MPa.

The present invention actively utilizes the properties of the supercritical fluid and/or subcritical fluid to produce toner particles by polymerizing at least radically polymerizable monomers.

A supercritical fluid can be readily isolated from the target product and can be recycled for reuse. Thus, it is possible to realize an epoch-making, environment-friendly toner production process that eliminates the need to use water and/or organic solvents as required in conventional processes.

At least one of the supercritical fluid and subcritical fluid preferably contains a surfactant.

The surfactant is not particularly limited and can be appropriately selected depending on the intended purpose, as long as it bears in a molecule moiety(s) that has an affinity for a supercritical fluid and moiety(s) that has an affinity for radically polymerizable monomers. In a case of supercritical $CO_2$, for example, compounds with bulky groups (e.g., groups containing a fluorine atom, groups containing a silicon atom, carbonyl group, short-chain hydrocarbon groups, and propylene oxide) are preferable because they act as compounds having an affinity for $CO_2$. Among these, fluorine-containing compounds, silicon-containing compounds, and carbonyl group-containing compounds are most preferable.

The fluorine-containing compounds are not particularly limited as long as they are compounds containing a perfluoroalkyl group of 1 to 30 carbon atoms; they may be either low-molecular weight compounds or high-molecular weight compounds. Among these, high-molecular weight fluorine-containing compounds are preferable in view of their excellent surfactant potency and of excellent charging properties and durability of resultant toner particles.

Examples of the high-molecular weight fluorine-containing compounds include those expressed by the following structural formulae (A) and (B). Note, however, that such compounds may be homopolymers, block copolymers, or random copolymers in view of the affinity for radically polymerizable monomers.

Structural Formula (A)

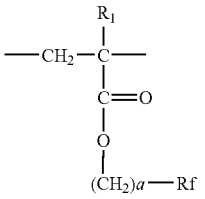

where $R_1$ represents a hydrogen atom or a lower alkyl group of 1 to 4 carbon atoms, a represents an integer of 1 to 4, and Rf represents a perfluoroalkyl group of 1 to 30 carbon atoms or a perfluoroalkenyl group.

Structural Formula (B)

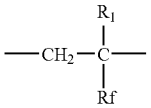

where $R_1$ represents a hydrogen atom or a lower alkyl group of 1 to 4 carbon atoms, and Rf represents a perfluoroalkyl group of 1 to 30 carbon atoms or a perfluoroalkenyl group.

A number of chemical materials similar to the foregoing perfluoroalkyl group-containing compounds are commercially available (see catalogue by AZmax Co., Ltd.). Various fluorine-containing compounds can also be obtained using them.

The silicon-containing compounds are not particularly limited as long as they are compounds having a siloxane bond; they may be either low-molecular weight compounds or high-molecular weight compounds. Among these, compounds having a polydimethylsiloxane (PDMS) expressed by the following structural formula (C) are preferable.

Structural Formula (C)

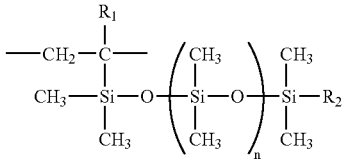

where $R_1$ represents a hydrogen atom or a lower alkyl group of 1 to 4 carbon atoms, n represents a repeating unit, and $R_2$ represents a hydrogen atom, a hydroxyl group, or an alkyl group of 1 to 10 carbon atoms.

A number of chemical materials similar to the foregoing polydimethylsiloxanes are commercially available (see catalogue by AZmax Co., Ltd.). Various surfactants can also be obtained using them.

These fluorine-containing compounds and silicon-containing compounds can be produced by polymerization of polymerizable vinyl monomers that can be polymerized in a supercritical fluid (preferably supercritical carbon dioxide) in addition to conventional solvents.

The carbonyl group-containing compounds are not particularly limited and can be appropriately selected depending on the intended purpose. Examples include aliphatic polyesters and polyacrylates.

The content of the surfactant in a composition containing at least radically polymerizable monomers is preferably 0.01% by mass to 30% by mass, more preferably 0.1% by mass to 20% by mass.

A dispersing agent may be included in at least one of the supercritical fluid and subcritical fluid.

Such a dispersing agent is not particularly limited and can be appropriately selected depending on the intended purpose. Examples include organic particles and inorganic particles. Among these, silicone-modified inorganic particles, fluorine-modified inorganic particles, fluorine-containing organic particles, and silicone-containing organic particles are preferable.

Examples of the organic particles include silicone-modified acrylic particles and fluorine-modified acrylic particles, which are insoluble in supercritical fluids.

Examples of the inorganic particles include polyvalent metal salts of phosphoric acid such as calcium phosphate, magnesium phosphate, aluminum phosphate, and zinc phosphate; carbonates such as calcium carbonate, and magnesium carbonate; inorganic salts such as calcium metasilicate, calcium sulfate, and barium sulfate; and inorganic oxides such as calcium hydroxide, aluminum hydroxide, silica, titanium oxide, bentonite, and alumina. Among these, silica is most preferable.

Specific examples of a fluorine-containing silane coupling agent are:

$$CF_3(CH_2)_2SiCl_3 \quad (1)$$

$$CF_3(CF_2)_5SiCl_3 \quad (2)$$

$$CF_3(CF_2)_5(CH_2)_2SiCl_3 \quad (3)$$

$$CF_3(CF_2)_7(CH_2)_2SiCl_3 \quad (4)$$

$$CF_3(CF_2)_7CH_2CH_2Si(OCH_3)_3 \quad (5)$$

$$CF_3(CF_2)_7(CH_2)_2Si(CH_3)Cl_2 \quad (6)$$

$$CF_3(CH_2)_2Si(OCH_3)_3 \quad (7)$$

$$CF_3(CH_2)_2Si(CH_3)(OCH_3)_2 \quad (8)$$

$$CF_3(CF_2)_3(CH_2)_2Si(OCH_3)_3 \quad (9)$$

$$CF_3(CF_2)_5CONH(CH_2)_2Si(OC_2H_5)_3 \quad (10)$$

$$CF_3(CF_2)_4COO(CH_2)_2Si(OCH_3)_3 \quad (11)$$

$$CF_3(CF_2)_7(CH_2)_2Si(OCH_3)_3 \quad (12)$$

$$CF_3(CF_2)_7(CH_2)_2Si(CH_3)(OCH_3)_2 \quad (13)$$

$$CF_3(CF_2)_7SO_2NH(CH_2)_3Si(OC_2H_5)_3 \quad (14)$$

$$CF_3(CF_2)_8(CH_2)_2Si(OCH_3)_3 \quad (15)$$

The content of the dispersing agent in a composition containing at least radically polymerizable monomers is preferably 0.1% by mass to 30% by mass, more preferably 0.2% by mass to 20% by mass. Although it is preferable that the dispersing agent be used singly, a surfactant may be used together in view of toner particle size control and toner charging properties.

Additional fluid(s) may be used together with the supercritical fluid and subcritical fluid. For such additional fluids, those capable of facilitating control of the solubilities of toner constituting materials are preferable. Methane, ethane, propane, ethylene and the like are suitable examples.

Moreover, an entrainer may be used together with the supercritical fluid and subcritical fluid. The addition of an entrainer facilitates the polymerization of polymerizable monomers. Such an entrainer is not particularly limited and can be appropriately selected depending on the intended purpose; polar organic solvents are preferable. Examples of such polar organic solvents include methanol, ethanol, propanol, butanol, hexane, toluene, ethyl acetate, chloroform, dichloroethane, ammonia, melamine, urea, and thioethyleneglycol. Among these, lower alcohol solvents are preferable that are poor solvents for toner binder resin at normal temperature and pressure (25° C., 0.1 MPa). Herein, the term "poor solvent" means a solvent capable of dissolving 0.1 g or less of resin in 1 L.

The entrainer is preferably selected from those that cannot dissolve resin particles or those that cause the resin particles to swell upon exposure thereto. More specifically, the difference in SP value between the entrainer and resin particles is preferably 1.0 or greater, more preferably 2.0 or greater. In a case of styrene-acrylic resins, for example, either alcohols with higher values of SP (e.g., methanol, ethanol and n-propane) or those with lower values of SP (e.g., n-hexane and n-heptane) are preferably used. However, if the SP value difference is too large, it results in poor wettability of the resin particles and thus they are not well dispersed in the solution. For this reason, an optimal SP value difference is in a range of 2 to 5.

When an entrainer is mixed with at least one of the supercritical fluid and subcritical fluid, the entrainer is preferably present in the fluid in an amount of 0.1% by mass to 10% by mass, more preferably 0.5% by mass to 5% by mass. If less than 0.1% by mass is used, entrainer's effects may not be obtained. If greater than 10% by mass is used, entrainer's properties as a liquid becomes so prominent that it may be difficult to obtain a supercritical state or subcritical state.

-Resin Particles-

The resin particles (or toner base particles) are not particularly limited and can be appropriately selected depending on the intended purpose, as long as they are resin particles that can be used for the formation of images. Examples include resin particles prepared using the pulverization method or polymerization method. The polymerization method is not particularly limited and can be appropriately selected from a suspension method, emulsification method, dispersion method and the like, depending on the intended purpose.

Note that the toner may also be produced by microcapsulation or the like (e.g., spray drying or coacervation) rather than using the pulverization and polymerization methods.

The resin particles may be newly prepared or may be purchased ready-made.

The pulverization method is one for producing the resin particles (toner base particles) by melting and kneading material containing at least binder resin, followed by pulverization and size classification and the like. Note in this pulverization method that mechanical impacts may be applied to the resultant toner particles to control their shapes so that the average circularity can be increased. In this case, such mechanical impacts are applied to the toner base particles using, for example, a hybridizer or a mechanofusion machine.

Resin particles prepared by polymerization are not particularly limited and can be appropriately selected from known resins depending on the intended purpose. Examples include vinyl resins, polyurethane resins, epoxy resins, polyester resins, polyamide resins, polyimide resins, silicon resins, phenol resins, melamine resins, urea resins, aniline resins, ionomer resins, and polycarbonate resins. The vinyl resins noted above are homopolymers or copolymers of vinyl monomers; examples include styrene-(meth)acrylate resins, styrene-butadiene copolymers, (meth)acrylic acid-acrylic acid ester polymers, styrene-acrylonitrile copolymers, styrene-maleic anhydride copolymers, and styrene-(meth)acrylic acid copolymers.

In addition, because of their sharp particle size distribution, resin particles made of, for example, polycondensation resin or thermosetting resin are preferable that can be prepared using a soap-free emulsion polymerization method, suspension polymerization method, dispersion polymerization method or the like. Examples of polycondensation resins and thermosetting resins include polystyrenes, methacrylates, acrylate copolymers, silicone resins, benzoguanamine and nylons. Among these, resin particles prepared using the dispersion polymerization method are preferable because they offer shaper particle size distributions. Alternatively, resin particles made of polyester resin or polyol resin can be used to provide toner with low-temperature fixation capability. That is, appropriate resin can be selected depending on the desired toner design.

Next, the dispersion polymerization method will be described.

To a hydrophilic organic liquid is added a high-molecular weight dispersing agent that can be dissolved in the liquid. The resultant polymer particles swell upon exposure to the hydrophilic organic liquid but are practically insoluble. Subsequently, one or more kinds of vinyl monomers are added to form resin particles. The dispersion polymerization also includes a reaction in which polymer particles with a smaller particle diameter than is originally desired but with a sharp particle size distribution are utilized in this reaction system to extend the polymer chain. Monomers utilized in the growth reaction may be either identical to or different from those used for the production of the seed particle. However, in either case, the resultant polymer should not be dissolved in the hydrophilic organic liquid.

For such a hydrophilic organic liquid, liquids that dissolve employed monomers rather than resultant resin particles (polymer particles) are used. Examples include alcohols such as methyl alcohol, ethyl alcohol, modified ethyl alcohol, isopropyl alcohol, n-butyl alcohol, isobutyl alcohol, tert-butyl alcohol, sec-butyl alcohol, tert-amino alcohol, 3-pentanol, octyl alcohol, benzyl alcohol, cyclohexanol, furfuryl alcohol, ethyleneglycol, glycerin, and diethyleneglycol; and ether alcohols such as methyl cellosolve, cellosolve, isopropyl cellosolve, butyl cellosolve, ethyleneglycol monomethyl ether, ethyleneglycol monoethyl ether, diethyleneglycol monomethyl ether, and diethyleneglycol monoethyl ether. These organic liquids may be used singly or in combination. By using organic liquids other than those described above in combination to produce different values of SP of the produced polymer particles under conditions where they are not rendered soluble in the organic liquid, it is possible to control the particle size and to prevent the occurrence of association of particles and creation of new particles.

Examples of organic liquids other than the foregoing alcohols and ether alcohols include carbon hydrides such as hexane, octane, petroleum ether, cyclohexane, benzene, toluene, and xylene; halogenated carbon hydrides such as carbon tetrachloride, trichloroethylene, and tetrabromoethane; ethers such as ethyl ether, dimethylglycol, trioxane, and tetrahydrofuran; acetals such as methylal, and diethylacetal; ketones such as acetone, methyl ethyl ketone, methyl isobutyl ketone, and cyclohexanone; esters such as butyl formate, butyl acetate, ethyl propionate, and cellosolve acetate; acids such as formic acid, acetic acid, and propionic acid; sulfur- or nitrogen-containing organic compounds such as nitropropene, nitrobenzene, and dimethylamine; and water.

Polymerization may be carried out in a solvent consisting primarily of the foregoing hydrophilic organic liquid(s) under the presence of $SO_4^{2-}$, $NO_2^-$, $PO_4^{3-}$, $Cl^-$, $Na^+$, $K^+$, $Mg^{2+}$, $Ca^{2+}$ and/or other inorganic ions. In addition, it is possible to control the average particle diameter, particle size distribution, drying conditions, etc. of polymer particles by changing the type and composition of the organic solvent in the three phases of the polymerization reaction—initial phase, intermediate phase, and last phase.

The high-molecular weight dispersing agent is not particularly limited and can be appropriately selected depending on the intended purpose. Examples include homopolymers of various kinds of monomers or copolymers thereof, polyoxyethylene resins, and celluloses. Here, examples of such monomers include acids such as acrylic acid, methacrylic acid, α-cyanoacrylic acid, α-cyanomethacrylic acid, itaconic acid, crotonic acid, fumaric acid, maleic acid, and maleic acid anhydride; acrylic monomers; vinyl alcohol or ethers of vinyl alcohol; esters of vinyl alcohol with carboxylic group-containing compounds; acrylamide, methacrylamide, diacetoneacryliamide or methylol derivatives thereof; acid chlorides such as acrylic acid chloride, and methacrylic acid chloride; and heterocyclic compounds.

The high-molecular weight dispersing agent is appropriately selected depending on the hydrophilic organic liquid to be used, on the type of desired polymer particles, and on the choice between seed particle production and propagating particle production. In particular, in order to prevent association of polymer particles spatially, a high-molecular weight dispersing agent should be selected from those having a high affinity and high adsorptive properties for the surfaces of the polymer particles and having a high affinity and high solubility for hydrophilic organic liquids. In addition, those with molecular chains of certain length, particularly those with a molecular weight of 10,000 or more, are preferable in order to cause polymer particles to repel one another strongly. However, if the molecular weight is too high, the viscosity of the solution increases remarkably, making it difficult to agitate the solution. Accordingly, special caution needs to be made because variations occur in the likelihood of deposition of produced polymers onto the surfaces of particles. In addition, allowing some of the foregoing monomers used for the production of the high-molecular weight dispersing agent to coexist with monomers that will constitute polymer particles is effective in the stabilization of the resultant polymer particles.

The amount of a high-molecular weight dispersing agent to be used for the production of seed particle generally varies depending on the identity of monomers used to produce polymer particles. However, such a high-molecular weight dispersing agent is preferably present in the hydrophilic organic liquid in an amount of from 0.1% by mass to 10% by mass of the hydrophilic organic liquid and, more preferably, from 1% by mass to 5% by mass. Lower amounts cause polymer particles to have relatively large diameters. On the other hand, higher amounts provide small polymer particles. However, amounts in excess of 10% by mass provide little effects in the reduction of particle size.

The combined use of an inorganic compound powder and/or a surfactant with such a high-molecular weight dispersing agent can also stabilize produced polymer particles and improve the particle size distribution. Thus, in order to prevent association of polymer particles during a growth reaction, these materials may be added to a vinyl monomer solution and/or to a seed particle-dispersed solution—solutions added to prevent association of polymer particles during a growth reaction—before polymerization. Polymer particles produced at the initial phase of reaction are stabilized by the high-molecular weight dispersing agent that is in equilibrium between the hydrophilic organic liquid and the polymer particle surface. However, when a large amount of unreacted monomers are present in the hydrophilic organic liquid, the polymer particles somewhat swell and become viscous, clumping together by overcoming the spatial repelling force provided by the high-molecular weight dispersing agent.

When an excess amount of unreacted monomers are present in the hydrophilic organic liquid, these monomers precipitate only after polymerization in which produced polymers are completely dissolved in the solution has progressed to some extent. In this case, these monomers precipitate as a highly viscous mass. For this reason, the amount of monomers used to produce resin particles with respect to a hydrophilic organic liquid is not particularly limited; such monomers are preferably present in a hydrophilic organic liquid in an amount of 100% by mass or less of the hydrophilic organic liquid and, more preferably, 50% by mass or less, though it slightly varies depending on the type of the hydrophilic organic liquid.

General radical initiators that can be dissolved in the used solvent are used as the polymerization initiator. Examples include azo-based polymerization initiators such as 2,2'-azobisisobutyronitrile, and 2,2-azobis(2,4-dimethylvaleronitrile); peroxide-based polymerization initiators such as lauryl peroxide, benzoyl peroxide, tert-butyl peroctoate, potassium persulfate, and peroxide-based polymerization initiators combined with sodium thiosulfate, amines and the like.

The added amount of the polymerization initiator is preferably 0.1 part by mass to 10 parts by mass per 100 parts of vinyl monomers. Polymerization is carried out in the following manner: After completely dissolving a high-molecular weight dispersing agent in a hydrophilic organic liquid, one or more kinds of vinyl monomers, a polymerization initiator, etc. are added to the resultant solution. Subsequently, the solution is heated to a temperature corresponding to the dispersion rate of the polymerization initiator with agitation at speed that establishes uniform flow in the solution. Note that because the initial phase temperature significantly affects the particle diameter of the resultant polymer particles, it is preferable that monomers be added before heating to a polymerization temperature, followed by addition of a small aliquot of solvent in which a polymerization initiator is dissolved.

Upon polymerization, it is preferable that oxygen in the reaction vessel be fully purged using inert gas such as nitrogen gas or argon gas. If oxygen is not fully purged, minute particles may result.

For increased polymerization efficiency, polymerization time is preferably 5 hours to 40 hours. It is possible to increase the polymerization rate by quenching the reaction at the time when polymer particles with a desired particle diameter and/or desired particle size distribution have been produced, by adding small aliquots of the polymerization initiator through the course of the reaction, or by carrying out the polymerization under high pressure.

In order to adjust the average molecular weight of resin particles, polymerization may be carried out in the presence a compound having a large chain transfer constant. Examples of such a compound include low-molecular weight compounds bearing mercapto groups, carbon tetrachloride, and carbon tetrabromide.

In the suspension polymerization method, a colorant, a releasing agent, etc. are dispersed in a mixture of an oil-soluble polymerization initiator and polymerizable monomers, and the resultant monomer mixture is emulsified and dispersed by emulsification to be described later in an aqueous medium containing a surfactant, a solid dispersing agent, etc. After a polymerization reaction to produce toner particles of the present invention, a wet process may be performed for attaching inorganic particles to their surfaces. At this point, inorganic particles are preferably attached to toner particles after removal of surfactant or the like by washing.

Using some of the following polymerizable monomers it is possible to introduce functional group(s) to the resin particle surface. Examples of such polymerizable monomers include acids such as acrylic acid, methacrylic acid, α-cyanoacrylic acid, α-cyanomethacrylic acid, itaconic acid, crotonic acid, fumaric acid, maleic acid, and maleic acid anhydride; acrylamide, methacrylamide, diacetoneacryliamide and methylol derivatives thereof; acrylates and methacrylates bearing amino groups, such as vinylpyridine, vinylpyrrolidone, vinylimidazole, ethyleneimine, and dimethylaminoethyl methacrylate.

Alternatively, functional groups can be introduced by using a dispersing agent having an acidic group and/or basic group that adsorbs to the resin particle surface.

In the emulsion polymerization method, a water-soluble polymerization initiator and polymerizable monomers are emulsified in water using a surfactant, followed by production of latex using a general emulsion polymerization method. Separately, a colorant, a releasing agent, etc. are dispersed in an aqueous medium to prepare a dispersion, which is then mixed with the latex. The latex particles are then coagulated to toner particle size, heated, and fused to one another to produce toner particles. Subsequently, a later described wet process may be performed for the attachment of inorganic particles. Functional group(s) can be introduced to the resin particle surface by using monomers similar to those that may be used for the suspension polymerization of the latex.

In the dissolution, suspension and extension method, for example, a toner material containing an active hydrogen-containing compound, a polymer capable of reacting with the active hydrogen-containing compound, a colorant, and a releasing agent is dissolved or dispersed in an organic solvent to prepare a toner solution. Thereafter, the toner solution is emulsified or dispersed in an aqueous medium to prepare a dispersion. In the aqueous medium, the active hydrogen-containing compound and the polymer capable of reacting with the active hydrogen-containing compound are reacted together to produce a particulate adhesive base material, followed by removal of the organic solvent to obtain a toner.

Examples of such a toner material include those containing at least an adhesive base material and, on an as-needed basis, additional ingredient(s) such as resin particles and/or a charge-controlling agent, the adhesive base material being obtained by reacting together an active hydrogen-containing compound, a polymer capable of reacting with the active hydrogen-containing compound, a binder resin, a colorant, and a releasing agent.

The method for forming the resin particles (toner base particles) is not particularly limited and can be appropriately determined depending on the intended purpose, as long as at least radically polymerizable monomers are polymerized in at least one of the supercritical fluid and subcritical fluid.

The apparatus used for the formation of the resin particles (toner base particles) is not particularly limited and can be appropriately determined depending on the intended purpose. For example, an apparatus equipped with a pressure-resistant vessel where a composition having at least radically polymerizable monomers is placed for the polymerization of the monomers to produce toner particles, and with a pressure pump for supplying a supercritical fluid is a preferable example. The processing method using such an apparatus is as follows: At first, the pressure-resistant vessel is charged with a composition having at least radically polymerizable monomers, and a supercritical fluid is introduced in the vessel by the pressure pump, allowing the composition to contact the supercritical fluid to produce resin particles. When the supercritical fluid is brought to normal temperature and pressure (25° C., 0.1 MPa), the supercritical fluid becomes gas, thus eliminating the need to remove solvents and avoiding the generation of waste solution resulting from the washing of resin particle surface as conventionally required. Thus, it is possible to reduce environmental impacts.

The temperature at which the radically polymerizable monomers in the composition are polymerized is not particularly limited and can be appropriately determined depending on the intended purpose, as long as it is at or above the critical temperature of the supercritical fluid or subcritical fluid. The upper limit of critical temperature is preferably at or below the melting point of the material for forming the resin particles. More preferably, the critical temperature is in a range where the resin particles are never fused to one another. Moreover, the lower limit is preferably a temperature below of which the foregoing additional fluid that can be mixed with the supercritical fluid cannot exist as gas.

More specifically, the temperature at which a resin layer is formed is preferably 0° C. to 100° C., more preferably 20° C. to 80° C. If this temperature exceeds 60° C., resin particles may dissolve.

The pressure during the polymerization reaction is not particularly limited and can be appropriately determined depending on the intended purpose, as long as it is at or above the critical pressure of a supercritical fluid or subcritical fluid to be adopted. However, the pressure is preferably 1 MPa to 60 MPa.

Next, a method for forming resin particles using the polymerization apparatus will be described.

The polymerization apparatus shown in FIG. 1 has a reaction vessel 9 of 1,000 $cm^3$ in volume. In FIG. 1 reference numeral 2 represents an entrainer tank; 4, a pressure pump; 6, a temperature sensor; 113, a discharge nozzle; and 114, a pressure sensor.

Here, carbon dioxide ($CO_2$) is used as the gas made supercritical. A composition having at least radically polymerizable monomers is placed into the reaction vessel 9.

Next, carbon oxide gas is supplied from a gas container, pressurized by the pressure pump 3, and introduced into the reaction vessel 9 via a valve 7. At this time, a valve 5 is closed and therefore the carbon oxide gas is not introduced into a discharge vessel 112, and a decompression valve 8 for exhaust and discharge is kept closed. Thus, introduction of high-pressure carbon dioxide increases the pressure inside the reaction vessel 9. In addition, the temperature inside the reaction vessel is adjusted to 320K by means of a heater 117.

A supercritical state is established in the reaction vessel 9 at the time when the inner pressure has reached 7.3 MPa. The valves 5 and 7 are adjusted to set the inner pressure of the reaction vessel 9 to 20 MPa, causing the composition in the reaction vessel 9 to dissolve in supercritical carbon dioxide. In this state, the valves 5 and 7 are closed, the composition is allowed to remain dissolved in the supercritical carbon dioxide for 120 minutes, and the supercritical fluid is distributed throughout the reaction vessel 9. Thereafter, the valve 7 is opened to adjust the inner pressure of the reaction vessel 9 to 10 MPa, and this state is retained for 60 minutes. Carbon dioxide gas is again introduced into the reaction vessel 9 from the high-pressure pump side. Introduction of carbon dioxide gas is continued while maintaining the inner pressure of the reaction vessel to 10 MPa. At this point, supercritical carbon dioxide and the composition dissolved therein are recovered by means of a recover mechanism (not shown), and are separated into discrete ingredients (carbon dioxide and composition) by means of a separator (not shown), each of which is recycled for reuse.

By keeping introduction of supercritical carbon dioxide, the dissolved composition having at least radically polymerizable monomers is completely ejected out of the vessel, leaving the reaction vessel 9 only with produced resin particles and a supercritical carbon dioxide fluid. Thereafter, the valves are opened to allow the supercritical carbon dioxide fluid to turn into gas to purify resin particles.

The number-average molecular weight (Mn) of the resin particles (toner base particles) is not particularly limited and can be appropriately determined depending on the intended purpose; it is preferably 1,000 to 500,000. In addition, the weight-average molecular weight (Mw) of the resin particles (toner base particles) is preferably 2,000 to 1,000,000.

The molecular weight of the resin particles can be determined by GPC (Gel Permeation Chromatography) under the following condition:

Instrument: GPC-150C (Waters Corporation)

Columns: KF801-807 (Shodex)

Temperature: 40° C.

Solvent: THF (tetrahydrofuran)

Flow rate: 1.0 ml/min

Samples: samples containing concentrations of 0.05-0.6% by mass (0.1 ml)

In this way a molecular weight distribution of the resin particles is obtained, and using a molecular weight calibration curve constructed from monodisperse polystyrene standards, the number-average molecular weight (Mn) and weight-average molecular weight (Mw) of the resin particles are calculated.

The resultant resin particles are suitably used as toner base particles, and preferably contain a colorant, a charge controlling agent, a releasing agent, and additional ingredient(s).

The charge controlling agent is not particularly limited and can be appropriately selected from those known in the art. However, when a colored material is used for the charge controlling agent, toner may show different tones of color and, therefore, colorless materials or materials close to white are preferably used. Examples include nigrosine dyes, triphenylmethane dyes, chrome-containing metal complex dyes, molybdic acid chelate pigments, rhodamine dyes, alkoxy amines, quaternary ammonium salts (including fluoride-modified quaternary ammonium salts), alkylamides, phosphous or compounds thereof, tungsten or compounds thereof, fluoride activators, metal salts of salicylic acid, and metal salts of salicylic acid derivatives. Among these, metal salts of salicylic acid, and metal salts of salicylic acid derivatives are preferable. These may be used singly or in combination. In addition, examples of metals that form such salts include aluminum, zinc, titanium, strontium, boron, silicon, iron, chrome, and zirconium.

For the charge controlling agent, commercially available products may be used; examples include Bontron P-51, a quaternary ammonium salt, Bontron E-82, an oxynaphthoic acid metal complex, Bontron E-84, a salicylic acid metal complex, and Bontron E-89, a phenol condensate (produced by Orient Chemical Industries, Ltd.); TP-302 and TP-415, both are a quaternary ammonium salt molybdenum metal complex (produced by Hodogaya Chemical Co.); Copy Charge PSY VP2038, a quaternary ammonium salt, Copy Blue PR, a triphenylmethane derivative, and Copy Charge NEG VP2036 and Copy Charge NX VP434, both are a quaternary ammonium salt (produced by Hoechst Ltd.); LRA-901, and LR-147, a boron metal complex (produced by Japan Carlit Co., Ltd.); quinacridones; azo pigments; and high-molecular weight compounds bearing a functional group (e.g., sulfonic group and carboxyl group).

The added amount of the charge controlling agent is not particularly limited and can be appropriately determined depending on the intended purpose; the charge controlling agent is preferably added in an amount of 0.5 part by mass to 5 parts by mass per 100 parts by mass of the resin particles and, more preferably, 1 part by mass to 3 parts by mass. If less than 0.5 part by mass is used, it may result in poor toner charging ability. If greater than 5 parts by mass is used, charging properties of toner becomes exceedingly enhanced, reducing the effect of the charge controlling agent primarily used, and an electrostatic suction force that presses toner against developing rollers increases. Thus, it may cause reduction in the flowability of the developer and/or in image density.

The releasing agent is not particularly limited and can be appropriately selected from those known in the art, depending on the intended purpose; waxes are suitable examples.

Examples of such waxes include low-molecular weight polyolefin waxes, synthesized hydrocarbon waxes, natural waxes, petroleum waxes, high fatty acids and metal salts thereof, high fatty acid amides, and modifications of these waxes. These may be used singly or in combination.

Examples of the low-molecular weight polyolefin waxes include low-molecular weight polyethylene waxes and low-molecular weight polypropylene waxes.

Examples of the synthesized hydrocarbon waxes include Fischer-Tropsh waxes.

Examples of the natural waxes include bee wax, Carnauba wax, Candelilla wax, Montan wax, and rice wax.

Examples of the high fatty acids include stearic acid, palmitic acid, and myristic acid.

The melting point of the releasing agent is not particularly limited and can be appropriately determined depending on the intended purpose. The melting point of the releasing agent is preferably 40° C. to 160° C., more preferably 50° C. to 120° C., most preferably 60° C. to 90° C.

If the melting point of the releasing agent is less than 40° C., thermal stability of wax may be reduced. If the melting point of the releasing agent is greater than 160° C., it is likely that cold offset may occur during a low-temperature fixing process, and a paper sheet is likely to wind itself around the fixing device.

The added amount of the releasing agent is not particularly limited and can be appropriately determined depending on the intended purpose. However, the releasing agent is preferably added in an amount of 1 part by mass to 20 parts by mass per 100 parts by mass of the resin particles and, more preferably 3 parts by mass to 15 parts by mass.

The colorant is not particularly limited and can be appropriately selected from known dyes and pigments accordingly. Examples include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone.

These may be used singly or in combination.

The dyes are not particularly limited and can be appropriately selected depending on the intended purpose. Examples include C.I.SOLVENT YELLOW (6, 9, 17, 31, 35, 100, 102, 103, 105), C.I.SOLVENT YELLOW ORANGE (2 ,7, 13, 14, 66), C.I.SOLVENT RED (5, 16, 17, 18, 19, 22, 23, 143, 145, 146, 149, 150, 151, 157, 158), C.I.SOLVENT VIOLET (31, 32, 33, 37), C.I.SOLVENT BLUE (22, 63, 78, 83-86, 191, 194, 195, 104), C.I.SOLVENT GREEN (24, 25), and C.I.SOLVENT BROWN (3, 9).

In addition, commercially available dyes are not particularly limited and can be appropriately selected depending on the intended purpose. Examples include Aizen SOT dyes such as Yellow-1, 3, 4, Orange-1, 2, 3, Scarlet-1, Red-1, 2, 3, Brown-2, Blue-1,2, Violet-1, Green-1, 2, 3, and Black-1, 4, 6, 8 (produced by Hodogaya Chemical Co., Ltd.); Sudan dyes such as Yellow-146, 150, Orange-220, Red-290, 380, 460, and Blue-670 (produced by BASF Japan, Ltd.); Diaresin Yellow-3G, F, H2G, HG, HC, HL, Diaresin Orange-HS, G, Diaresin Red-GG, S, HS, A, K, H5B, Diaresin Violet-D, Diaresin Blue-J, G, N, K, P, H3G, 4G, Diaresin Green-C, and Diaresin Brown-A (produced by Mitsubishi Chemical Industries. Ltd.); Oil Color Yellow-3G, GG-S, #105, Oil Color Orange-PS, PR, #201, Oil Color Scarlet-#308, Oil Color Red-5B, Oil Color Brown-GR, #416, Oil Color Green-BG, #502, Oil Color Blue-BOS, IIN, and Oil Color Black-HBB, #803, EB EX (produced by Orient Chemical Industries, Ltd.); Sumiplast Blue-GP, OR, Sumiplast Red-FB, 3B, and Sumiplast Yellow FL7G, GC (produced by Sumitomo Chemical Co., Ltd.); and Kayaron Polyester Black EX-SF300, Kayaset Red-B, and Kayaset Blue-A-2R (produced by Nihon Kayaku Co., Ltd).

The added amount of the colorant is not particularly limited, and can be appropriately determined depending on the degree of coloration. The colorant is preferably added in an amount of 1 part by mass to 50 parts by mass per 100 parts by mass of the resin particles.

A flowability improver, one of the aforementioned additional ingredient, means an agent that improves hydrophobic properties of resin particles through surface treatment and is capable of preventing reduction of the flowability and/or charging ability of resin particles even when exposed to high humidity environment. Examples include silane coupling agents, sililating agents, silane coupling agents bearing a fluorinated alkyl group, organotitanate coupling agents, aluminum-based coupling agents, silicone oils, and modified silicone oils.

A cleaning improver is added to the resin particles to remove a developer remaining on a photoconductor and/or on a primary transferring member after a transferring step. Examples include zinc stearate, calcium stearate, stearic acid, and polymer particles prepared by soap-free emulsion polymerization such as polymethylmethacrylate particles and polyethylene particles. Among these, polymer particles with a relatively narrow particle size distribution are preferable, and polymer particles with a volume-average particle diameter of 0.01 μm to 1 μm are more preferable.

The following can be used as the method for adding additives (e.g., the foregoing charge controlling agent, releasing agent, and colorant) to the resin particles: A method in which resin particles are kneaded after the addition of additives, or a method in which one of a supercritical fluid and a subcritical fluid is used. The former method is most preferable.

In this method for kneading resin particles after the addition of additives, resin particles, known additives, resin, etc. are mixed together using a mixer (e.g., HENSCHEL MIXER), and thereafter, the constituent materials are kneaded using a batch double roll, a banbary mixer, or a continuous double-screw extruder (e.g., KTK type double-screw extruder manufactured by KOBE STEEL, LTD., TEM type double-screw extruder manufactured by TOSHIBA MACHINE CO., LTD., TEX type double-screw extruder manufactured by Japan Steel Works, LTD., PCM type double-screw extruder manufactured by Ikegai Corp., KEX type double-screw extruder manufactured by KURIMOTO, LTD., or continuous type single-screw kneader (for example, a thermal kneader such as Co-kneader manufactured by Buss)). Where appropriate, the resultant mixture is molded into pellets or sheets using any of various injectors, and then cooled. In this way the additives can be included in the resin particles. In addition, the resin particles may be coarse-grained using a hammer mill or the like as needed, further pulverized into fine particles using a jet stream pulverizer or mechanical pulverizer, and classified according to a given particle size using a classifier utilizing circular airflow or a classifier utilizing the Coanda effect.

<Toner>

The toner of the present invention is produced by the toner production process of the present invention and contains additional ingredient(s) as needed.

The shape, size, and several features of the toner are not particularly limited and can be appropriately determined depending on the intended purpose. The toner preferably offers the following image density, average circularity, weight-average particle diameter, ratio of weight-average particle diameter to number-average particle diameter (weight-average particle diameter/number-average particle diameter), etc.

The image density is preferably 1.90 or more, more preferably 2.00 or more, most preferably 2.10 or more, as determined using a spectrometer (X-Rite 938 SpectroDensitometer).

If the image density is less than 1.90, it results in low image density and thus high quality images may not be obtained.

The image density can be measured as follow: A solid image with a deposited developer amount of 1.00±0.05 mg/cm$^2$ is formed on a copy sheet (Type 6000<70W>, Ricoh Company, Ltd.) using Imagio Neo 450 (Ricoh Company, Ltd.) having a fixing roller whose surface temperature is set to 160±2° C. Subsequently, the image densities of 6 randomly chosen points are measured using a spectrometer (X-Rite 938 SpectroDensitometer), followed by calculation of the mean of the measured values.

The average circularity is a measure obtained by dividing the circumference of a circle that has the same area as an actual projected area of a toner particle by the circumference of that toner particle, and is preferably 0.900 to 0.980, more preferably 0.950 to 0.975. Note that it is preferable that the proportion of particles having the average circularity of less than 0.940 be 15% or less of the total particles.

If the average circularity is less than 0.900, it may result in poor transfer properties and toner dust-free high quality images may not be obtained. If the average circularity is greater than 0.980, it becomes likely that cleaning failures occur on the photoconductor and transfer belt in an image-forming system equipped with a cleaning blade, causing smears on images. For example, in a case of formation of an image that occupies a large area of a sheet (e.g., photographic images), background smears may occur because, when paper feed failure or the like occurs, toner particles that have been used to develop the image remains unremoved and accumulates on the photoconductor, or, in that case, a charging roller which provides charges to the photoconductor becomes soiled by residual toner particles and thus its original charging ability may be impaired.

The average circularity can be measured using a flow particle image analyzer (e.g., FPIA-2100, Sysmex Corp.)

Measurements are made in the following manner. Tiny dusts in water are first moved by filtration so that the number of particles to be measured (e.g., circle equivalent diameter of 0.60 μm to less than 159.21 μm) is 20 or less per $10^{-3}$ cm$^3$, followed by addition of a few droplets of nonionic surfactant (preferably "Contaminon" produced by Wako Pure Chemical Industries, Ltd.) and 5 mg of sample to 10 ml of the water. The mixture is then homogenized using a distributed machine (UH-50, SMT Co., Ltd.) for 1 minute at 20 kHz and 50 W/10 cm$^3$. Homogenization continues for a further 5 minutes, preparing a sample solution with a particle concentration of 4,000-8,000/$10^{-3}$ cm$^3$ (particles with a circle equivalent diameter of 0.60 μm to less than 159.21 μm). The particle size distribution of these particles is then determined as follows.

The sample solution is allowed to flow through a flat, transparent flow cell (thickness: about 200 μm) that extends in the flow direction. A flash lamp and a CCD camera are arranged on opposite sides of the flow cell to establish an optical path that crosses the flow cell. While the sample solution is running, a strobe light flashes at 1/30-second intervals to obtain a 2D image of each particle in the flow cell. By calculating the diameter of a circle that has the same area as the 2D image, the circle equivalent diameter of the particle is determined.

The circle equivalent diameters of 1,200 or more particles can be determined in about 1 minute, and the number and proportion (number-based %) of particles with a specified circle equivalent diameter can be determined on the basis of the circle equivalent diameter distribution. Measurement results (frequency % and accumulation %) can be obtained by dividing a particle size range (0.06 μm to 400 μm) into 226 channels (30 channels per octave). In actual measurements, particles with a circle equivalent diameter of 0.60 μm to less than 159.21 μm are subjected to measurements.

The weight-average particle diameter of the toner is not particularly limited and can be appropriately determined depending on the intended purpose. For example, the weight-average particle diameter is preferably 3 μm to 10 μm, more preferably 3 μm to 8 μm.

If the weight-average particle diameter is less than 3 μm, in a case of two-component developer, toner may fuse to the carrier surface to reduce its charging properties as a result of a long-time agitation in a developing unit, and in a case of a one-component developer, toner filming may occur at a developing roller or toner may more likely to fuse to members (e.g., blade) because of its reduced layer thickness. If the weight-average particle diameter is greater than 10 μm, it becomes difficult to obtain images of high resolution and high quality, and the variations in the toner particle diameter may be large when new toner is added to the developer to compensate the consumed toner.

The ratio of weight-average particle diameter to number-average particle diameter is preferably 1.00 to 1.25, more preferably 1.00 to 1.10. If this ratio exceeds 1.25, in a case of two-component developer, toner may fuse to the carrier surface to reduce its charging properties as a result of a long-time agitation in the developing unit, and in a case of a one-component developer, toner filming may occur at the developing roller or toner may more likely to fuse to members (e.g., blades) because of its reduced layer thickness. In addition, it becomes difficult to obtain images of high resolution and high quality, and the variations in toner particle diameter may be large when toner is added to the developer to compensate the consumed toner.

The weight-average particle diameter and the ratio of weight-average particle diameter to number-average particle diameter can be determined using, for example, Coulter Counter TA-II, a particle size analyzer manufactured by Beckmann Coulter Inc.

The glass transition temperature of the toner is preferably 40° C. to 70° C. If the glass transition temperature is less than 40° C., it may result in insufficient thermal stability, whereas if the glass transition temperature is greater than 70° C., low-temperature fixing properties may be impaired.

Glass transition temperature (Tg) as used herein is determined in the following manner using TA-60WS and DSC-60 (Shimadzu Corp.) under the conditions described below.

[Measurement Conditions]
Sample container: aluminum sample pan (with a lid)
Sample amount: 5 mg
Reference: aluminum sample pan (10 mg of alumina)
Atmosphere: nitrogen (flow rate: 50 ml/min)
Temperature Condition:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

Measurement results are analyzed using date analysis software (TA-60, version 1.52, Shimadzu Corp.). The glass transition temperature is determined from DrDSC curve—a DSC transition curve for the second heating operation—by a glass transition temperature analysis function of the device. In the present invention the first shoulder portion of the graph, where glass transition starts, is defined as the glass transition temperature.

<Developer>

The developer used in the present invention comprises toner of the present invention and appropriately selected additional ingredient(s) such as a carrier. The developer may be either a one-component or a two-component developer; however, when it is applied to high-speed printers that support increasing information processing rates of recent years, a two-component developer is preferable in view of achieving an excellent shelf life.

In the case of a one-component developer comprising the toner of the present invention, the variations in the toner particle diameter are minimized even after consumption or addition of toner, and toner filming to a developing roller and toner adhesion to members (e.g., blade) due to its reduced layer thickness are prevented. Thus, it is possible to provide excellent and stable developing properties and images even after a long time usage of the developing unit (i.e., after long time agitation of developer). Meanwhile, in the case of a two-component developer comprising the toner of the present invention, even after many cycles of consumption and addition of toner, the variations in the toner particle diameter are minimized and, even after a long time agitation of the developer in the developing unit, excellent and stable developing properties may be obtained.

-Carrier-

The carrier is not particularly limited and can be appropriately selected depending on the intended purpose. However, the carrier is preferably selected from those having a core material and a resin layer coating the core material.

The material for the core is not particularly limited and can be appropriately selected from conventional materials; for example, materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 emu/g to 120 emu/g) are preferable. In addition, weak magnetizing materials such as copper-zinc (Cu—Zn)-based materials (30 emu/g to 80 emu/g) are preferable from the standpoint for achieving higher-grade images by reducing the contact pressure against the photoconductor having standing toner particles. These materials may be used singly or in combination.

The particle diameter of the core material, in terms of volume-average particle diameter, is preferably 10 μm to 150 μm, more preferably 40 μm to 100 μm.

If the average particle diameter (volume-average particle diameter ($D_{50}$)) is less than 10 μm, fine particles make up a large proportion of the carrier particle distribution, causing carrier splash due to reduced magnetization per one particle in some cases; on the other hand, if it exceeds 150 μm, the specific surface area of the particle decreases, causing toner splashes and reducing the reproducibility of images, particularly the reproducibility of solid-fills in full-color images Materials for the resin layer are not particularly limited and can be properly selected from conventional resins depending on the intended purpose; examples include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and silicone resins. These resins may be used singly or in combination.

Examples of the amino resins include urea-formaldehyde resins, melamine resins, benzoguanamine resins, urea resins, polyamide resins, and epoxy resins. Examples of the polyvinyl resins include acrylic resins, polymethyl methacrylate resins, polyacrylonitrile resins, polyvinyl acetate resins, polyvinyl alcohol resins, and polyvinyl butyral resins. Examples of the polystyrene resins include polystyrene resins, and styrene-acryl copolymer resins. Examples of the halogenated olefin resins include polyvinyl chloride. Examples of the polyester resins include polyethylene terephthalate resins, and polybutylene terephthalate resins.

The resin layer may contain such material as conductive powder depending on the application; for the conductive powder, metal powder, carbon black, titanium oxide, tin oxide, zinc oxide, and the like are exemplified. These conductive powders preferably have an average particle diameter of 1 μm or less. If the average particle diameter is greater than 1 μm, it may be difficult to control electrical resistance.

The resin layer may be formed by dissolving the silicone resin or the like into a solvent to prepare a coating solution, uniformly coating the surface of the core material with the coating solution by a known coating process, and dying and baking the core material. Examples of the coating process include immersing process, spray process, and brush painting process, The solvent is not particularly limited and cab be appropriately selected depending on the intended purpose. Examples include toluene, xylene, methyl ethyl ketone, methyl isobutyl ketone, cellusolve, and butylacetate.

The baking process may be an externally heating process or an internally heating process, and can be selected from, for example, a process using a fixed type electric furnace, a fluid type electric furnace, a rotary type electric furnace or a burner furnace, and a process using microwave.

The content of the resin layer in the carrier is preferably 0.01% by mass to 5.0% by mass. If the content is less than 0.01% by mass, it may be difficult to form a uniform resin layer on the surface of the core material, on the other hand, if the content exceeds 5.0% by mass, the resin layer becomes so thick that carrier particles may associate together. Thus, it may result in failure to obtain uniform carrier particles.

When the developer is a two-component developer, the content of the carrier in the two-component developer is not particularly limited and may be appropriately determined depending on the intended purpose; for example, it is preferably 90% by mass to 98% by mass, more preferably 93% by mass to 97% by mass.

Since the developer comprises the toner of the present invention, it offers excellent charging properties upon formation of an image and can realize stable formation of high-quality images.

The developer can be suitably applied to a variety of known electrophotographic image formation processes including a magnetic one-component developing process, non-magnetic one-component developing process, and two-component developing process, particularly to a toner container, process cartridge, image forming apparatus and image forming method of the present invention, all of which will be described below.

(Toner Container)

The toner container used in the present invention is a container supplied with the toner of the present invention or the developer.

The toner container is not particularly limited and can be appropriately selected from conventional containers; for example, a toner container having a container main body and a cap is a suitable example.

The size, shape, structure, material and several features of the container main body is not particularly limited and can be appropriately determined depending on the intended purpose. For example, the container main body preferably has a cylindrical shape, most preferably a cylindrical shape in which spiral grooves are formed on its inner surface that allow toner in the container to shift to the outlet along with rotation of the main body, and in which all or part of the spiral grooves have a bellow function.

Materials for the container main body are not particularly limited and are preferably those capable of providing accurate dimensions when fabricated; examples include resins. For example, polyester resins, polyethylene resins, polypropylene resins, polystyrene resins, polyvinyl chloride resins, polyacrylic acid resins, polycarbonate resins, ABS resins, and polyacetal resins are suitable examples.

The toner container can be readily stored and transferred, and is easy to handle. The toner container can be suitably used to supply toner by detachably attaching it to a process cartridge, image forming apparatus or the like to be described later.

(Process Cartridge)

The process cartridge used in the present invention comprises a latent electrostatic image bearing member configured to bear a latent electrostatic image, and a developing unit configured to develop the latent electrostatic image formed on the latent electrostatic image bearing member using a toner to thereby form a visible image, and further comprises additional unit(s) appropriately selected.

The developing unit comprises a developer container for storing the toner of the present invention or the developer, and a developer carrier for carrying and transferring the toner or developer stored in the developer container, and may further comprises a layer-thickness control member for controlling the thickness of the layer of toner to be carried.

Figure 2:
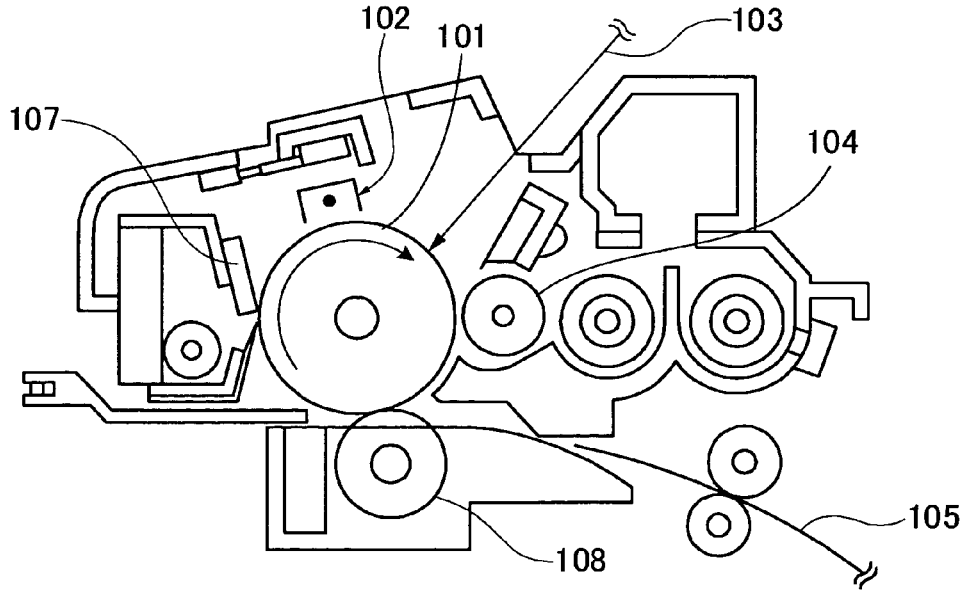
FIG. 2 is a schematic view of an example of a process cartridge.

The process cartridge comprises, for example, as shown in FIG. 2, a built-in latent electrostatic image bearing member 101, charging unit 102, developing unit 104, transferring unit 108, and cleaning unit 107 and, if necessary, further comprises additional unit(s). In FIG. 2, 103 denotes exposure light by means of an exposing unit, and 105 denotes a recording medium.

Next, an image formation process by means of the process cartridge shown in FIG. 2 will be described. The latent electrostatic image bearing member 101 rotates in the arrow direction, charged by means of the charging unit 102 and is irradiated with the exposure light 103 by means of an exposing unit (not shown), whereby a latent electrostatic image corresponding to the exposed image is formed thereon. This electrostatic image is developed by means of the developing unit 104, and the resultant visible image is transferred to the recording medium 105 by means of the transferring unit 108. The recording medium 105 is then printed out. Subsequently, the surface of the latent electrostatic image bearing member 101 is cleaned by means of the cleaning unit 107, and charges are removed by means of a charge-removing unit (not shown). This whole process is continuously repeated.

(Image Formation Method and Image Formation Apparatus)

The image forming method of the present invention comprises a latent electrostatic image forming step, a developing step, a transferring step and a fixing step, and further comprises additional step(s) such as a charge removing step, a cleaning step, a recycling step and a controlling step, which are optionally selected as needed.

The image forming apparatus used in the present invention comprises an latent electrostatic image bearing member, a latent electrostatic image forming unit, a developing unit, a transferring unit and a fixing unit, and further comprises additional unit(s) such as a charge eliminating unit, a cleaning unit, a recycling unit and a controlling unit, which are optionally selected as needed.

The latent electrostatic image forming step is a step of forming a latent electrostatic image on a latent electrostatic image bearing member.

The material, shape, size, structure, and several features of the latent electrostatic image bearing member (referred to as "photoconductor" or "electrographic photoconductor" in some cases) are not particularly limited. The latent electrostatic image bearing member can be appropriately selected from those known in the art. However, a drum shaped-latent electrostatic image bearing member is a suitable example. For the material constituting the latent electrostatic image bearing member, inorganic photoconductive materials such as amorphous silicon and selenium, and organic photoconductive materials such as polysilane and phthalopolymethine are preferable. Among these, amorphous silicon is preferable in view of its long life.

The formation of the latent electrostatic image is achieved by, for example, exposing the latent electrostatic image bearing member imagewisely after equally charging its entire surface. This step is performed by means of the latent electrostatic image forming unit.

The latent electrostatic image forming unit comprises a charging device configured to equally charge the surface of the latent electrostatic image bearing member, and an exposing device configured to imagewisely expose the surface of the latent electrostatic image bearing member.

The charging step is achieved by, for example, applying voltage to the surface of the latent electrostatic image bearing member by means of the charging device.

The charging device is not particularly limited and can be appropriately selected depending on the intended purpose; examples include known contact-charging devices equipped with a conductive or semiconductive roller, blush, film or rubber blade; and known non-contact-charging devices utilizing corona discharge such as corotron or scorotoron.

The exposure step is achieved by, for example, exposing the surface of the photoconductor imagewisely by means of an exposing unit.

The exposing device is not particularly limited as long as it is capable of performing image-wise exposure on the surface of the charged latent electrostatic image bearing member by means of the charging device, and may be appropriately selected depending on the intended use; examples include various exposing devices, such as optical copy devices, rod-lens-eye devices, optical laser devices, and optical liquid crystal shatter devices.

Note in the present invention that a backlight system may be employed for exposure, where image-wise exposure is performed from the back side of the latent electrostatic image bearing member.

-Developing and Developing Unit-

The developing step is a step of developing the latent electrostatic image using the toner of the present invention or developer to form a visible image.

The formation of the visible image can be achieved, for example, by developing the latent electrostatic image using the toner of the present invention or the developer. This is performed by means of the developing unit.

The developing unit is not particularly limited as long as it is capable of performing developing by means of the toner of the present invention or the developer, and can be appropriately selected from known developing units depending on the intended purpose; suitable examples include those having at least a developing device, which is capable of housing the toner of the present invention or the developer therein and is capable of directly or indirectly applying the toner or developer to the latent electrostatic image. A developing device equipped with the toner container is more preferable.

The developing device may be of dry developing type or wet developing type, and may be designed either for monochrome or multiple-color; suitable examples include those having an agitation unit for agitating the toner or developer to provide electrical charges by frictional electrification, and a rotatable magnet roller.

In the developing device the toner and carrier are mixed together and the toner is charged by friction, allowing the rotating magnetic roller to bear toner particles in such a way that they stand on its surface. In this way a magnetic blush is formed. Since the magnet roller is arranged in the vicinity of the latent electrostatic image bearing member (photoconductor), some toner particles on the magnetic roller that constitute the magnetic blush electrically migrate to the surface of the latent electrostatic image bearing member (photoconductor). As a result, a latent electrostatic image is developed by means of the toner, forming a visible image, or a toner image, on the surface of the latent electrostatic image bearing member (photoconductor).

The developer contained in the developing device is a developer containing the toner of the present invention. The developer may be either a one-component developer or a two-component developer. The toner contained in the developer is the toner of the present invention.

-Transferring and Transferring Unit-

The transferring step is a step of transferring the visible image onto a recording medium. A preferred embodiment of transferring involves two steps: primary transferring in which the visible image is transferred onto an intermediate transferring medium; and secondary transferring in which the visible image transferred onto the intermediate transferring medium is transferred onto a recording medium. A more preferable embodiment of transferring involves two steps: primary transferring in which a visible image is transferred onto an intermediate transferring medium to form a complex image thereon by means of toners of two or more different colors, preferably full-color toners; and secondary transferring in which the complex image is transferred onto a recording medium.

The transferring step is achieved by, for example, charging the latent electrostatic image bearing member (photoconductor) by means of a transfer charging unit. This transferring step is performed by means of the transferring unit. A preferable embodiment of the transferring unit has two units: a transferring unit configured to transfer a visible image onto an intermediate transferring medium to form a complex image; and a secondary transferring unit configured to transfer the complex image onto a recording medium.

The intermediate transferring medium is not particularly limited and can be selected from conventional transferring media depending on the intended purpose; suitable examples include transferring belts.

The transferring device (i.e., the primary and secondary transferring devices) preferably comprises a transferring device configured to charge and separate the visible image from the latent electrostatic image bearing member (photoconductor) and transfer it onto the recording medium. The number of the transferring device to be provided may be either 1 or more.

Examples of the transferring device include corona transferring devices utilizing corona discharge, transferring belts, transferring rollers, pressure-transferring rollers, and adhesion-transferring devices.

The recording medium is not particularly limited and can be appropriately selected from known recording media (recording sheets).

The fixing step is a step of fixing a transferred visible image onto a recording medium by means of the fixing unit. Fixing may be performed every time after each different toner has been transferred to the recording medium or may be performed in a single step after all different toners have been transferred to the recording medium.

The fixing device is not particularly limited and can be appropriately selected depending on the intended purpose; examples include a heating-pressurizing unit. The heating-pressurizing unit is preferably a combination of a heating roller and a pressurizing roller, or a combination of a heating roller, a pressurizing roller, and an endless belt, for example.

In general, heating treatment by means of the heating-pressurizing unit is preferably performed at a temperature of 80° C. to 200° C.

Note in the present invention that a known optical fixing unit may be used in combination with or instead of the fixing step and fixing unit, depending on the intended purpose.

The charge removing step is a step of applying a bias to the charged electrographic photoconductor for removal of charges. This is suitably performed by means of the charge eliminating unit.

The charge removing unit is not particularly limited as long as it is capable of applying a charge removing bias to the latent electrostatic image bearing member, and can be appropriately selected from conventional charge eliminating units depending on the intended purpose. A suitable example thereof is a charge removing lamp and the like.

The cleaning step is a step of removing toner particles remained on the latent electrostatic image bearing member. This is suitably performed by means of the cleaning unit. The cleaning unit is not particularly limited as long as it is capable of removing such toner particles from the latent electrostatic image bearing member, and can be suitably selected from conventional cleaners depending on the intended use; examples include a magnetic blush cleaner, a electrostatic brush cleaner, a magnetic roller cleaner, a blade cleaner, a blush cleaner, and a wave cleaner The recycling step is a step of recovering the toner particles removed through the cleaning step to the developing unit. This is suitably performed by means of the recycling unit.

The recycling unit is not particularly limited, and can be appropriately selected from conventional conveyance systems.

The controlling step is a step of controlling the foregoing steps. This is suitably performed by means of the controlling unit.

The controlling unit is not particularly limited as long as the operation of each step can be controlled, and can be appropriately selected depending on the intended use. Examples thereof include equipment such as sequencers and computers.

One embodiment of the image forming method of the present invention by means of the image forming apparatus will be described with reference to FIG. 3.

An image forming apparatus 100 shown in FIG. 3 comprises a photoconductor drum 10 (hereinafter referred to as a photoconductor 10) as the latent electrostatic image bearing member, a charging roller 20 as the charging unit, an exposure device 30 as the exposing unit, a developing device 40 as the developing unit, an intermediate transferring member 50, a cleaning device 60 as the cleaning unit having a cleaning blade, and a charge removing lamp 70 as the charge removing unit.

The intermediate transferring member 50 is an endless belt, and is so designed that it loops around three rollers 51 disposed its inside and rotates in the direction shown by the arrow by means of the rollers 51. One or more of the three rollers 51 also functions as a transfer bias roller capable of applying a certain transfer bias (primary bias) to the intermediate transferring member 50. A cleaning blade 90 is provided adjacent to the intermediate transferring member 50. There is provided a transferring roller 80 next to the intermediate transferring member 50 as the transferring unit capable of applying a transfer bias so as to transfer a developed image (toner image) to a transfer sheet 95, a recording medium (secondary transferring). Moreover, there is provided a corona charger 58 around the intermediate transferring member 50 for applying charges to the toner image transferred on the intermediate transferring medium 50. The corona charger 58 is arranged between the contact region of the photoconductor 10 and the intermediate transferring medium 50 and the contact region of the intermediate transferring medium 50 and the transfer sheet 95.

The developing device 40 comprises a developing belt 41 (a developer bearing member), a black developing unit 45K, yellow developing unit 45Y, magenta developing unit 45M and cyan developing unit 45C, the developing units being positioned around the developing belt 41. The black developing unit 45K comprises a developer container 42K, a developer supplying roller 43K, and a developing roller 44K. The yellow developing unit 45Y comprises a developer container 42Y, a developer supplying roller 43Y, and a developing roller 44Y. The magenta developing unit 45M comprises a developer container 42M, a developer supplying roller 43M, and a developing roller 44M. The cyan developing unit 45C comprises a developer container 42C, a developer supplying roller 43C, and a developing roller 44C. The developing belt 41 is an endless belt looped around a plurality of belt rollers so as to be rotatable. A part of the developing belt 41 is in contact with the latent electrostatic image bearing member 10.

Figure 3:
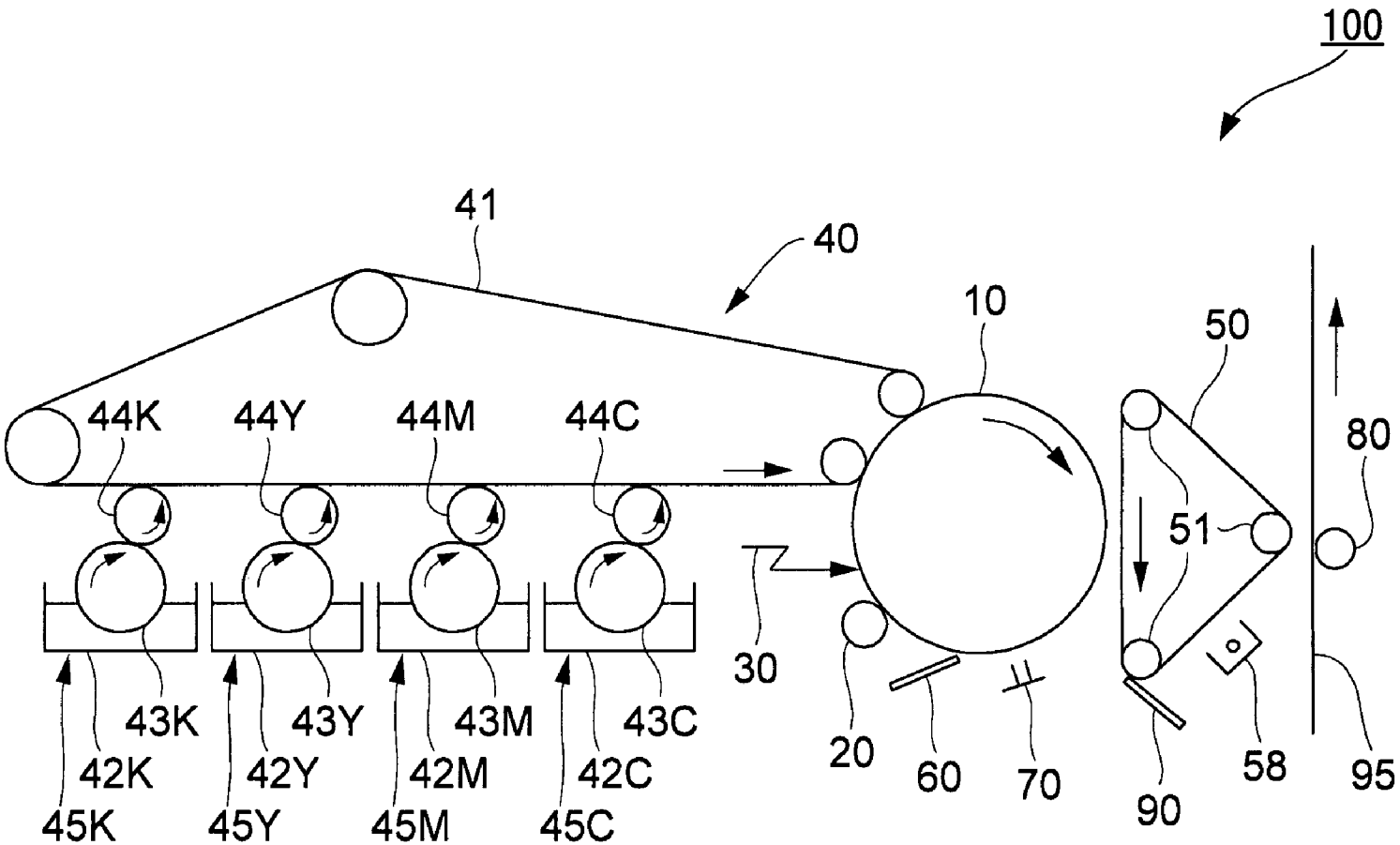
FIG. 3 is a schematic view for explaining an example of the image forming method of the present invention using an image forming apparatus.

In the image forming apparatus 100 shown in FIG. 3, the photoconductor drum 10 is uniformly charged by means of, for example, the charging roller 20. The exposure device 30 then applies light to the photoconductor drum 10 so as to form a latent electrostatic image. The latent electrostatic image formed on the photoconductor drum 10 is provided with toner from the developing device 40 to form a visible image (toner image). The roller 51 applies a bias to the toner image to transfer the visible image (toner image) onto the intermediate transferring medium 50 (primary transferring), and further applies a bias to transfer the toner image from the intermediate transferring medium 50 to the transfer sheet 95 (secondary transferring). In this way a transferred image is formed on the transfer sheet 95. Thereafter, toner particles remained on the photoconductor drum 10 are removed by means of the cleaning device 60, and charges of the photoconductor drum 10 are removed by means of the charge removing lamp 70 on a temporary basis.

Figure 4:
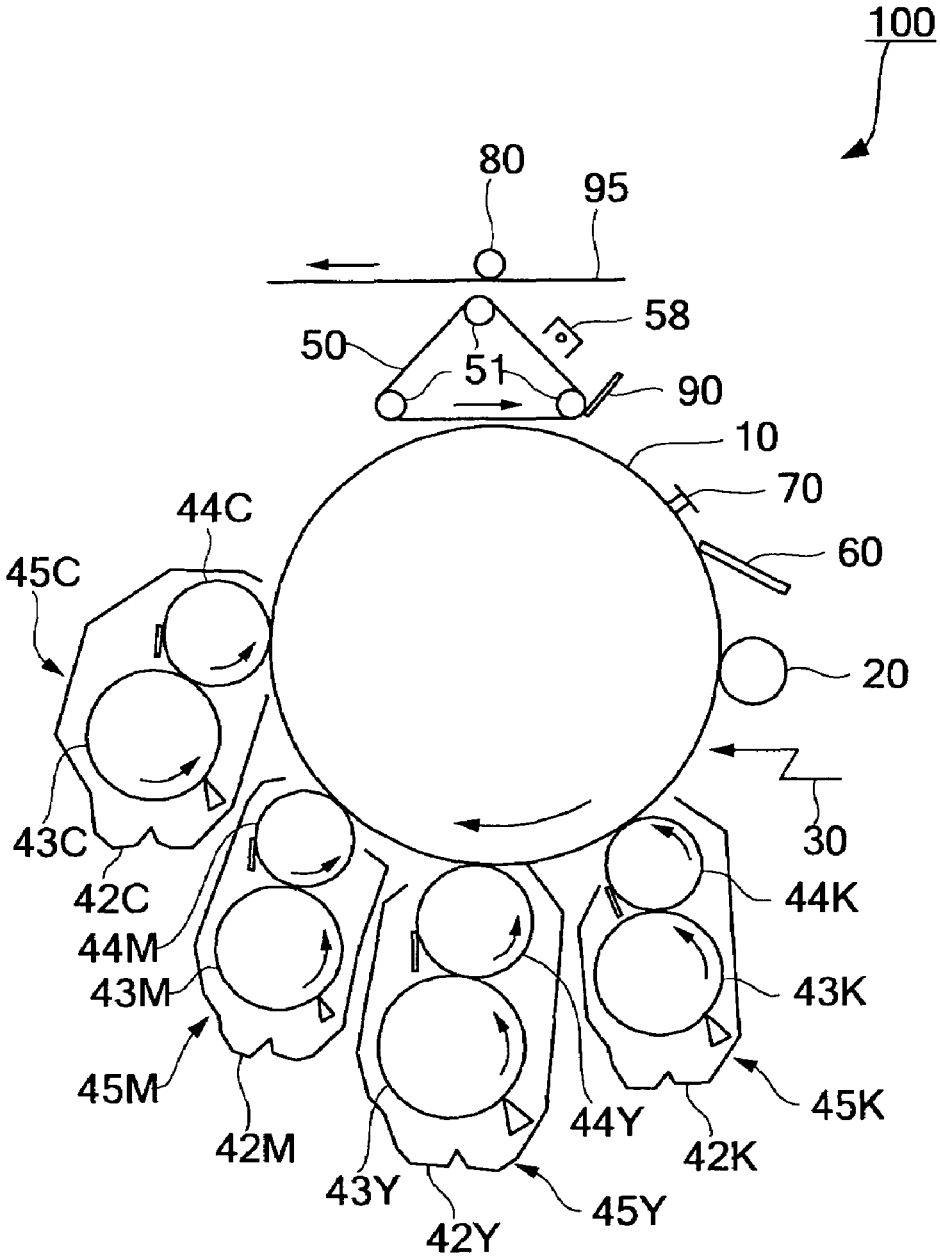
FIG. 4 is a schematic view for explaining another example of the image forming method of the present invention using an image forming apparatus.

Another embodiment of the image forming method of the present invention by means of the image forming apparatus will be described with reference to FIG. 4. The image forming apparatus 100 shown in FIG. 4 has an identical configuration and working effects to those of the image forming apparatus 100 shown in FIG. 3 except that this image forming apparatus 100 does not comprise the developing belt 41 and that the black developing unit 45K, yellow developing unit 45Y, magenta developing unit 45M and cyan developing unit 45C are disposed around the periphery of the photoconductor 10. Note in FIG. 4 that members identical to those in FIG. 3 are denoted by the same reference numerals.

Figure 5:
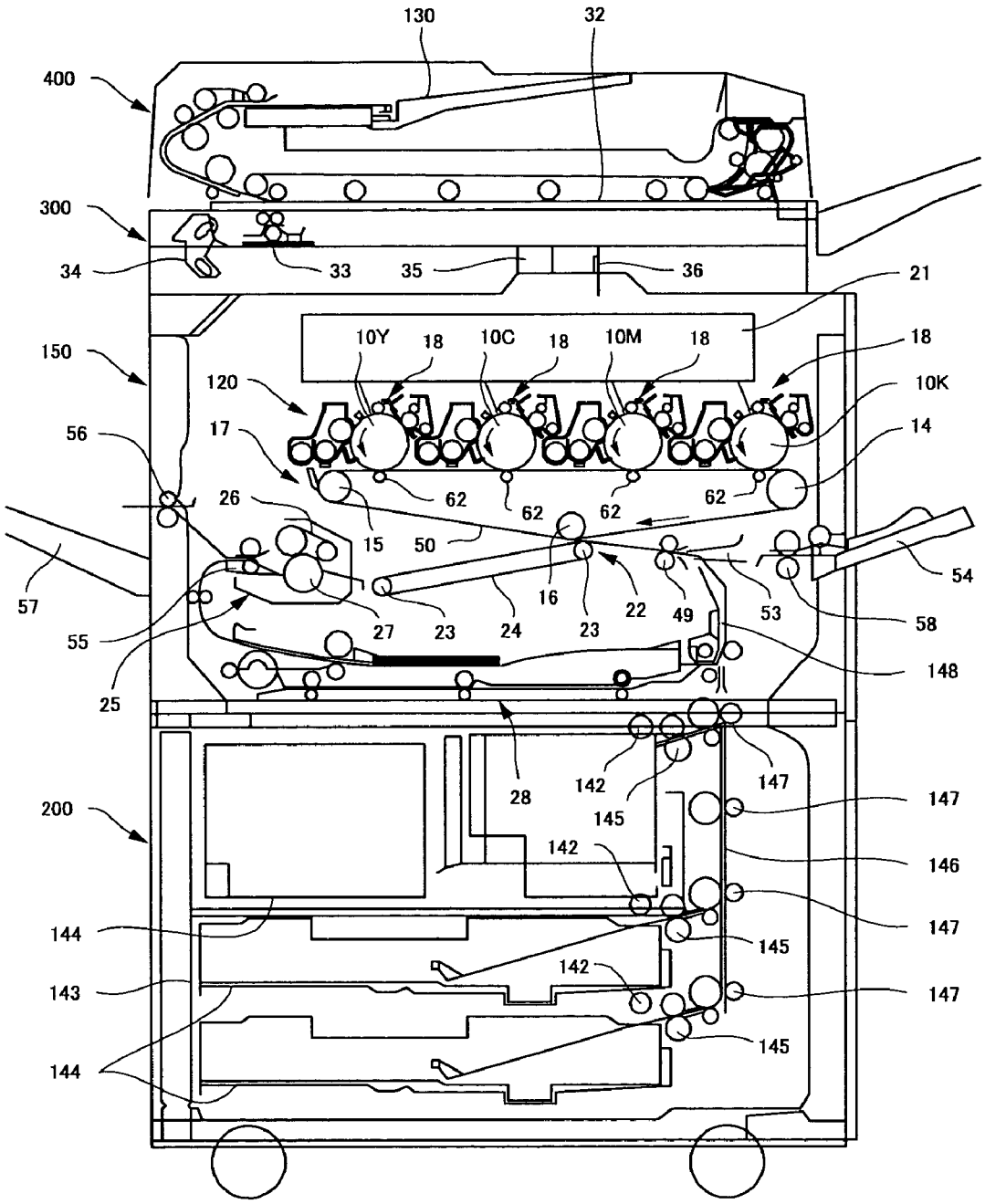
FIG. 5 is a schematic view for explaining an example of the image forming method of the present invention using an image forming apparatus (tandem color image forming apparatus)

Still another embodiment of the image forming method of the present invention by means of the image forming apparatus will be described with reference to FIG. 5. An image forming apparatus 100 shown in FIG. 5 is a tandem color image-forming apparatus. The tandem image forming apparatus comprises a copy machine main body 150, a feeder table 200, a scanner 300, and an automatic document feeder (ADF) 400. The copy machine main body 150 has an endless-belt intermediate transferring member 50 in the center. The intermediate transferring member 50 is looped around support rollers 14, 15 and 16 and is configured to rotate in a clockwise direction in FIG. 5. A cleaning device 17 for the intermediate transferring member is provided in the vicinity of the support roller 15. The cleaning device 17 removes toner particles remained on the intermediate transferring member 50.

On the intermediate transferring member 50 looped around the support rollers 14 and 15, four color-image forming devices 18—yellow, cyan, magenta, and black—are arranged, constituting a tandem developing unit 120. An exposing unit 21 is arranged adjacent to the tandem developing unit 120. A secondary transferring unit 22 is arranged across the intermediate transferring member 50 from the tandem developing unit 120. The secondary transferring unit 22 comprises a secondary transferring belt 24, an endless belt, which is looped around a pair of rollers 23. A paper sheet on the secondary transferring belt 24 is allowed to contact the intermediate transferring member 50. An image fixing device 25 is arranged in the vicinity of the secondary transferring unit 22. The image fixing device 25 comprises a fixing belt 26, an endless belt, and a pressurizing roller 27 which is pressed by the fixing belt 26.

In the tandem image forming apparatus, a sheet reverser 28 is arranged adjacent to both the secondary transferring unit 22 and the image fixing device 25. The sheet reverser 28 turns over s a transferred sheet to form images on the both sides of the sheet.

Next, full-color image formation (color copying) using the tandem developing unit 120 will be described. At first, a source document is placed on a document tray 130 of the automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred onto the contact glass 32, and the scanner is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color information—black, yellow, magenta, and cyan.

Figure 6:
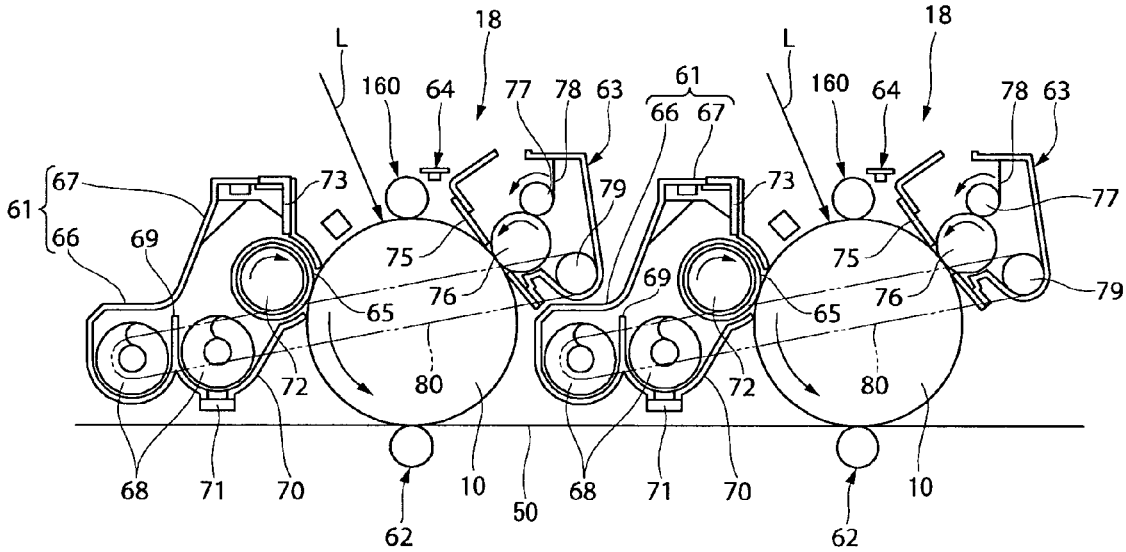
FIG. 6 is a partially enlarged schematic view of the image forming apparatus shown in FIG. 5.

Each piece of color information (black, yellow, magenta, and cyan) is transmitted to the image forming unit 18 (black image forming unit, yellow image forming unit, magenta image forming unit, or cyan image forming unit) of the tandem developing unit 120, and toner images of each color are formed in the image-forming units 18. As shown in FIG. 6, each of the image-forming units 18 (black image-forming unit, yellow image forming unit, magenta image forming unit, and cyan image forming unit) of the tandem developing unit 120 comprises: a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charging device 60 for uniformly charging the latent electrostatic image bearing member; an exposing unit for forming a latent electrostatic image corresponding to the color image on the latent electrostatic image bearing member by exposing it to light (denoted by "L" in FIG. 6) on the basis of the corresponding color image information; a developing device 61 for developing the latent electrostatic image using the corresponding color toner (black toner, yellow toner, magenta toner, or cyan toner) to form a toner image; a transfer charger 62 for transferring the toner image to the intermediate transferring member 50; a cleaning device 63; and a charge removing device 64. Thus, images of different colors (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transferring member 50 which rotates by means of support rollers 14, 15 and 16 (primary transferring). These toner images are overlaid on the intermediate transferring member 50 to form a composite color image (color transferred image).

Meanwhile, one of feed rollers 142 of the feed table 200 is selected and rotated, whereby sheets (recording sheets) are ejected from one of multiple feed cassettes 144 in the paper bank 143 and are separated one by one by a separation roller 145. Thereafter, the sheets are fed to a feed path 146, transferred by a transfer roller 147 into a feed path 148 inside the copying machine main body 150, and are bumped against a resist roller 49 to stop. Alternatively, one of the feed rollers 142 is rotated to eject sheets (recording sheets) placed on a manual feed tray. The sheets are then separated one by one by means of a separation roller 52, fed into a manual feed path 53, and similarly, bumped against the resist roller 49 to stop. Note that the resist roller 49 is generally earthed, but it may be biased for removing paper dusts on the sheets.

The resist roller 49 is rotated synchronously with the movement of the composite color image on the intermediate transferring member 50 to transfer the sheet (recording sheet) into between the intermediate transferring member 50 and the secondary transferring unit 22, and the composite color image is transferred onto the sheet by means of the secondary transferring unit 22 (secondary transferring). In this way the color image is formed on the sheet. Note that after image transferring, toner particles remained on the intermediate transferring member 50 are cleaned by means of the cleaning device 17.

The sheet (recording sheet) bearing the transferred color image is conveyed by the secondary transferring unit 22 into the image fixing device 25, where the composite color image (color transferred image) is fixed to the sheet (recording sheet) by heat and pressure. Thereafter, the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

The image forming method of the present invention and the image forming apparatus use the toner of the present invention with a sharp particle size distribution and excellent toner characteristics (e.g., charging properties, environmental impact, and temporal stability). Thus it is possible to form high-quality images.

Hereinafter, Examples of the present invention will be described, which however shall not be construed as limiting the invention thereto.

SYNTHESIS EXAMPLE 1

-Synthesis of Surfactant 1 (Perfluoroacrylate Resin)-

A pressure-resistant reaction cell was charged with 30 parts by volume of perfluorooctyl acrylate per 100 parts by volume of the inner volume of the cell. Carbon dioxide as a supercritical fluid was supplied from a gas container to the reaction cell. The cell pressure was increased to 30 MPa using a pressure pump, and the cell temperature was increased to 80° C. using a temperature adjuster. To the reaction cell was added AIBN (azobisisobutyronitrile), a polymerization initiator, in an amount of 1 part by mass per 100 parts by mass of perfluorooctyl acrylate, allowing a reaction to take place for 24 hours.

After termination of the reaction, using a back pressure valve, supercritical carbon dioxide was removed to the outside at a flow rate of 5.0 L/min over 6 hours, and monomers left over were removed. Thereafter, the reaction cell was gradually brought to normal temperature and pressure (25° C., 0.1 MPa) to prepare "Surfactant 1." The glass transition temperature (Tg) of Surfactant 1 was 50.5° C.

SYNTHESIS EXAMPLE 2

-Synthesis of Surfactant 2-

A pressure-resistant reaction cell was charged with 30 parts by volume of a monomer mixture consisting of 30 mol % perfluorooctyl acrylate and 70 mol % styrene per 100 parts by volume of the inner volume of the cell. Carbon dioxide as a supercritical fluid was supplied from a gas container to the reaction cell. The cell pressure was increased to 30 MPa using a pressure pump, and the cell temperature was increased to 80° C. using a temperature adjuster. To the reaction cell was added AIBN (azobisisobutyronitrile), a polymerization initiator, in an amount of 1 part by mass per 100 parts by mass of the monomer mixture, allowing a reaction to take place for 24 hours.

After termination of the reaction, using a back pressure valve, supercritical carbon dioxide was removed to the outside at a flow rate of 5.0 L/min over 6 hours, and monomers left over were removed. Thereafter, the reaction cell was gradually brought to normal temperature and pressure (25° C., 0.1 MPa) to prepare "Surfactant 2 (copolymer)."

SYNTHESIS EXAMPLE 3

-Synthesis of Surfactant 3-

A pressure-resistant reaction cell was charged with 30 parts by volume of a monomer mixture consisting of 70 mol % Mono Methacrylopropyl Terminated Poly Dimethylsiloxane (MCR-M17, produced by AZmax, Corp.), 24 mol % styrene and 6 mol % butyl acrylate per 100 parts by volume of the inner volume of the cell. Carbon dioxide as a supercritical fluid was supplied from a gas container to the reaction cell. The cell pressure was increased to 30 MPa using a pressure pump, and the cell temperature was increased to 80° C. using a temperature adjuster. To the reaction cell was added AIBN (azobisisobutyronitrile), a polymerization initiator, in an amount of 1 part by mass per 100 parts by mass of the monomer mixture, allowing a reaction to take place for 24 hours.

After termination of the reaction, using a back pressure valve, supercritical carbon dioxide was removed to the outside at a flow rate of 5.0 L/min over 6 hours, and monomers left over were removed. Thereafter, the reaction cell was gradually brought to normal temperature and pressure (25° C., 0.1 MPa) to prepare "Surfactant 3."

SYNTHESIS EXAMPLE 4

-Synthesis of Dispersing Agent 1-

Five parts by mass of titanium oxide (MT-500B, produced by Tayca, Corp.) was placed into a round-bottom flask having a magnetic stirrer and a trap, and dried for 24 hours at 110° C., followed by addition of 150 parts by mass of dehydrated toluene, 1.5 parts by mass of $CF_3(CF_2)_7CH_2CH_2Si(OCH_3)_3$, and 0.5 part by mass of acetic acid as a buffer agent. The resultant suspension was heated to reflux for 7 hours at 50° C. to 60° C., and cooled to room temperature. The product was then recovered by suction filtration, washed with toluene, and dried for 4 hours at 110° C. Subsequently, the product was washed with ethanol, dried for 4 hours at 110° C., and pulverized using an agate mortar. In this way "Dispersing Agent 1", which is white powder," was prepared.

EXAMPLE 1

-Preparation of Polymerizable Monomer Composition-

Polymerizable monomers consisting of 80 parts by mass of styrene and 20 parts by mass of n-butyl acrylate (the glass transition temperature (Tg) of resultant copolymer=55° C. (calculated value)), 0.5 part by mass of Surfactant 1, 0.3 part by mass of divinylbenzene, and 2 parts by mass of natural gas-based Fischer-Tropsh wax (FT-100, produced by D Shell MS, melting point: 92° C.) were vigorously mixed together using a TK homomixer (a high-shearing force mixer manufactured by Tokushu Kika Co., Ltd.) at 11,000 rpm. In this way "Polymerizable Monomer Composition 1 (mixture solution)" was prepared.

<Supercritical Polymerization Process>

To a pressure-resistant processing cell was added 100 parts by mass of Polymerizable Monomer Composition 1. As a supercritical fluid, carbon dioxide was supplied from a gas container to the cell. The cell pressure was increased to 30 MPa using a pressure pump, and the cell temperature was increased to 80° C. using a temperature adjuster. To the reaction cell was added 3 parts by mass of AIBN (azobisisobutyronitrile), a polymerization initiator, allowing a reaction to take place for 24 hours.

After termination of the reaction, using a back pressure valve, supercritical carbon dioxide was removed to the outside at a flow rate of 5.0 L/min over 6 hours, and monomers left over were removed. Thereafter, 0.5 part by mass of Oil Black HBB (produced by Orient Chemical Industries, Ltd.) and 0.02 part by mass of Oil Orange 201 (produced by Orient Chemical Industries, Ltd.) were added, and the resultant polymer was allowed to stand for 1 hour for coloring. The reaction cell was then gradually brought to normal temperature and pressure (25° C., 0.1 MPa) to prepare "Toner 1."

<Solubility for Supercritical Carbon Dioxide>

One gram of the polymerizable monomers was mixed with supercritical carbon dioxide in a high-pressure vessel (inner volume: 50 ml) having an inspection window and allowed to stand for 30 minutes. The polymerizable monomers were completely dissolved in the supercritical fluid—the fluid was not cloudy and no phase separation was enacted when seen through the inspection window.

One gram of the resultant polymer was mixed with supercritical carbon dioxide in a high-pressure vessel (inner volume: 50 ml) having an inspection window and allowed to stand for 30 minutes. The polymer was not dissolved in the supercritical fluid—the fluid was cloudy or phase separation was enacted when seen through the inspection window.

EXAMPLE 2

-Preparation of Polymerizable Monomer Composition-

Polymerizable monomers consisting of 80 parts by mass of styrene and 20 parts by mass of n-butyl acrylate (the glass transition temperature (Tg) of resultant copolymer=55° C. (calculated value)), 1 part by mass of Surfactant 2, 0.3 part by mass of divinylbenzene, 5 parts by mass of Carnauba wax (CWT101, produced by Toyo-Petrolite Corp.), and 7 parts by mass of C. I. Pigment Blue (15:3) were vigorously mixed together using a homomixer (a high-shearing force mixer manufactured by Tokushu Kika Co., Ltd.) at 11,000 rpm. In this way "Polymerizable Monomer Composition 2 (mixture solution)" was prepared.

<Supercritical Polymerization Process>

To a pressure-resistant processing cell equipped with the homomixer was added 100 parts by mass of Polymerizable Monomer Composition 2 and 1 part by mass of silica particles (average particle diameter: 20 nm) as a dispersing agent. As a supercritical fluid, carbon dioxide was supplied from a gas container to the cell. The cell pressure was increased to 10 MPa using a pressure pump, and the cell temperature was increased to 65° C. using a temperature adjuster. To the reaction cell was added 5 parts by mass of V-65 (polymerization initiator, 2,2'-azobis(2,4-dimethylvaleronitrile) produced by Wako Pure Chemical Industries, Ltd.) with agitation at 10,000 rpm, allowing a reaction to take place for 24 hours.

After termination of the reaction, using a back pressure valve, supercritical carbon dioxide was removed to the outside at a flow rate of 5.0 L/min over 6 hours, and monomers left over were removed. The reaction cell was gradually brought to normal temperature and pressure (25° C., 0.1 MPa) to prepare "Toner 2."

<Solubility for Supercritical Carbon Dioxide>

One gram of the polymerizable monomers was mixed with supercritical carbon dioxide in a high-pressure vessel (inner volume: 50 ml) having an inspection window and allowed to stand for 30 minutes. The polymerizable monomers were completely dissolved in the supercritical fluid—the fluid was not cloudy and no phase separation was enacted when seen through the inspection window.

One gram of the resultant polymer was mixed with supercritical carbon dioxide in a high-pressure vessel (inner volume: 50 ml) having an inspection window and allowed to stand for 30 minutes. The polymer was not dissolved in the supercritical fluid—the fluid was cloudy or phase separation was enacted when seen through the inspection window.

EXAMPLE 3

-Preparation of Polymerizable Monomer Composition-

Polymerizable monomers consisting of 80 parts by mass of styrene and 20 parts by mass of n-butyl methacrylate, 2 parts by mass of Surfactant 3, and 0.3 part by mass of divinylbenzene were vigorously mixed together using a homomixer (a high-shearing force mixer manufactured by Tokushu Kika Co., Ltd.) at 11,000 rpm. In this way "Polymerizable Monomer Composition 3 (mixture solution)" was prepared.

-Preparation of Supercritical Dispersion-

To a pressure-resistant processing cell equipped with the homomixer was added 5 parts by mass of synthesized ester wax (WEP05 produced by NOF Corp.) and 7 parts by mass of C. I. Pigment Blue (15:3). As a supercritical fluid, carbon dioxide was supplied from a gas container to the cell. The cell pressure was increased to 25 MPa using a pressure pump, and the cell temperature was increased to 80° C. using a temperature adjuster, followed by full agitation at 10,000 rpm. Thereafter, the reaction cell was adjusted to 25 MPa and 50° C. to prepare "Dispersion 1."

<Supercritical Polymerization Process>

To a pressure-resistant processing cell equipped with the homomixer was added 100 parts by mass of Polymerizable Monomer Composition 3. As a supercritical fluid, carbon dioxide was supplied from a gas container to the cell. The cell pressure was increased to 25 MPa using a pressure pump, and the cell temperature was increased to 80° C. using a temperature adjuster. To the reaction cell was added 2 parts by mass of V-65 (polymerization initiator, 2,2'-azobis(2,4-dimethylvaleronitrile) produced by Wako Pure Chemical Industries, Ltd.) with agitation, allowing a reaction to take place for 24 hours.

After termination of the reaction, using a back pressure valve, supercritical carbon dioxide was removed to the outside at a flow rate of 5.0 L/min over 6 hours, and monomers left over were removed. Dispersion 1 was then added to the cell at 25 MPa and 50° C. to prepare "Toner 3."

<Solubility for Supercritical Carbon Dioxide>

One gram of the polymerizable monomers was mixed with supercritical carbon dioxide in a high-pressure vessel (inner volume: 50 ml) having an inspection window and allowed to stand for 30 minutes. The polymerizable monomers were completely dissolved in the supercritical fluid—the fluid was not cloudy and no phase separation was enacted when seen through the inspection window.

One gram of the resultant polymer was mixed with supercritical carbon dioxide in a high-pressure vessel (inner volume: 50 ml) having an inspection window and allowed to stand for 30 minutes. The polymer was not dissolved in the supercritical fluid—the fluid was cloudy or phase separation was enacted when seen through the inspection window.

EXAMPLE 4

"Toner 4" was prepared in a manner similar to that described in Example 2, with Dispersing Agent 1 used in stead of silica particles.

EXAMPLE 5

A pressure-resistant processing cell was charged with 100 parts by mass of Polymerizable Monomer Composition 1, followed by addition of ethanol, an entrainer, in an amount of 1% by volume of the total volume of the cell. Carbon dioxide as a supercritical fluid was supplied from a gas container to the cell. The cell pressure was increased to 30 MPa using a pressure pump, and the cell temperature was increased to 80° C. using a temperature adjuster. To this cell was added 3 parts by mass of AIBN (azobisisobutyronitrile), a polymerization initiator, allowing a reaction to take place for 24 hours.

After termination of the reaction, using a back pressure valve, supercritical carbon dioxide was removed to the outside at a flow rate of 5.0 L/min over 6 hours, and monomers left over were removed. Thereafter, 0.5 part by mass of Oil Black HBB (produced by Orient Chemical Industries, Ltd.) and 0.02 part by mass of Oil Orange 201 (produced by Orient Chemical Industries, Ltd.) were added, and the resultant polymer was allowed to stand for 1 hour for coloring. The reaction cell was then gradually brought to normal temperature and pressure (25° C., 0.1 MPa) to prepare "Toner 5."

<Solubility for Supercritical Carbon Dioxide>

One gram of the polymerizable monomers was mixed with supercritical carbon dioxide in a high-pressure vessel (inner volume: 50 ml) having an inspection window and allowed to stand for 30 minutes. The polymerizable monomers were completely dissolved in the supercritical fluid—the fluid was not cloudy and no phase separation was enacted when seen through the inspection window.

One gram of the resultant polymer was mixed with supercritical carbon dioxide in a high-pressure vessel (inner volume: 50 ml) having an inspection window and allowed to stand for 30 minutes. The polymer was not dissolved in the supercritical fluid—the fluid was cloudy or phase separation was enacted when seen through the inspection window.

COMPARATIVE EXAMPLE 1

-Preparation of Resin Particles-

A hermetically-sealable reaction vessel equipped with a blade stirrer, a cooling condenser and a nitrogen gas inlet tube was installed to a temperature-controlled water bath, and charged with the following compositions:

| | |
|---|---|
| Ethanol | 70 Parts by Mass |
| Distilled water | 30 Parts by Mass |
| Polyvinylpyrolidone | 4 Parts by Mass |

Subsequently, the blade stirrer was rotated for complete dissolution of polyvinylpyrolidone, and the reaction vessel was charged with the following compositions:

| | |
|---|---|
| Styrene | 28 Parts by Mass |
| Ethyl acrylate | 10 Parts by Mass |
| n-butyl methacrylate | 2 Parts by Mass |
| Ethyleneglycol dimethacrylate | 0.2 Part by Mass |
| Carbon tetrachloride | 0.03 Part by Mass |
| Benzoyl peroxide | 0.6 Part by Mass |

While rotating the blade stirrer, nitrogen gas was introduced in the vessel to purge oxygen completely. The water bath was then heated to 50±0.1° C. to start polymerization reaction. Two hours later, the water bath was heated to 65±0.1° C. to increase the reaction rate.

After 12 hours from the start of the polymerization reaction, the water bath was cooled to room temperature to prepare a dispersion. An aliquot of the dispersion was subjected to gas chromatography using an internal standard method, yielding the degree of polymerization of greater than 90%. In this way Resin Particle 1 was prepared. In addition, a particle size distribution measurement on Resin Particle 1 using a Coulter Multisizer (100 μm-aperture tube) revealed that it has a weight-average particle diameter (D4) of 6.83 μm and a number-average particle diameter (Dn) of 6.04 μm, the (D4)/(Dn) being 1.13.

Next, 30 parts by mass of Solvent Black 30 was dissolved in 20 parts by mass of ethanol by heat, and non-dissolved ingredients were removed by filtration through a 1 μm-pore diameter filter. Thereafter, 20 parts by mass of the flow-through, 100 parts by mass of ethanol, and 100 parts by mass of Resin Particles 1 were measured into a vessel, and agitated at 50° C. for 1 hour for the coloring of resin particles. The obtained colored solution was then cooled to room temperature. The resin particles were precipitated by centrifugation, the supernatant was removed, and the resin particles were dispersed in ethanol 3 times. The resin particle solution was filtrated to produce "Comparative Toner 1."

COMPARATIVE EXAMPLE 2

-Preparation of Resin Paste-

A raw material consisting of 178 parts by mass of styrene-acrylic resion (glass transition temperature=65° C.) and 10 parts by mass of Carnauba wax (CWT01, produced by Toyo-Petrolite Corp.) was placed into a HENSCHEL MIXER, and agitated for 10 minutes to produce a raw material mixture. Using Kneadics MOS140-800 (manufactured by Mitsui Mining Co., Ltd.), this raw material mixture was mixed thoroughly by melting and kneading at a temperature 130° C. or less to prepare Resin Paste (P-1).

<Supercritical Polymerization Process>

To a pressure-resistant processing cell (1,000 ml) equipped with a mixer having a comb-shaped blade stirrer, heater, and temperature and pressure monitors was added 150 parts by mass of Resin Paste (P-1), 10 parts by mass of Surfactant 2, 10 parts by mass of phthalocyanine pigment (C. I. Pigment Blue (15:3)) and 1 part by mass of a charge controlling agent (aluminum salicylate). As a supercritical fluid, carbon dioxide was supplied from a gas container to the cell. The cell pressure was increased to 25 MPa using a pressure pump, and the cell temperature was increased to 90° C. using a temperature adjuster, followed by agitation at 3,000 rpm for 3 hours. The resultant mixture was cooled to 4° C., and the pressure-reducing valve was gradually released to prepare "Comparative Toner 2."

The weight-average particle diameter (D4) and number-average particle diameter (Dn) of Comparative Toner 2 determined in the following manner using Coulter Multisizer (100 μm-aperture tube) were 11.5 μm and 5.5 μm, respectively (D4/Dn=2.09). This means that the particle size diameter is broad. Moreover, both fine particles and coarse particles were generated.

One gram of the styrene-acrylic resin was mixed with a subcritical carbon dioxide in a high-pressure vessel (inner volume: 50 ml) having an inspection window, and the mixture was agitated for 30 minutes at 25 MPa and 90° C. The styrene-acrylic resin was not dissolved in the supercritical fluid—the fluid was cloudy or phase separation was enacted when seen through the inspection window.

<Measurement of Weight-Average Particle Diameter and Particle Size Distribution>

Examples of instruments for measuring the weight-average particle diameter and particle size distribution of toner using the Coulter Counter method include Coulter Counter TA-II and Coulter Multisizer II (manufactured by Beckmann Coulter Inc.) The measurement method will be described below.

First, as a dispersing agent, 0.1 ml to 5 ml of a surfactant (alkylbenzene sulfonate) is added to 100 ml to 150 ml of an electrolytic solution. Note that the electrolytic solution is an approx. 1 mass % aqueous solution of NaCl prepared using primary sodium chloride, and ISOTON-11 (Beckmann Coulter Inc.) can be used. Subsequently, 2 mg to 20 mg of sample to be measured is added to the mixture. The sample suspension is sonicated for 1 to 3 minutes using an ultrasonicator. Using the measurement instrument of 100 μm-aperture, the weight and the number of toner particles are measured to produce its volume distribution and number distribution, from which the weight-average particle diameter (D4) and number-average particle diameter (Dn) can be obtained.

For channels, 13 different channels are used—from 2.00 μm to less than 2.52 μm; from 2.52 μm to less than 3.17 μm; from 3.17 μm to less than 4.00 μm; from 4.00 μm to less than 5.04 μm; from 5.04 μm to less than 6.35 μm; from 6.35 μm to less than 8.00 μm; from 8.00 μm to less than 10.08 μm; from 10.08 μm to less than 12.70 μm; from 12.70 μm to less than 16.00 μm; from 16.00 μm to less than 20.20 μm; from 20.20 μm to less than 25.40 μm; from 25.40 μm to less than 32.00 μm; and from 32.00 μm to less than 40.30 μm—targeting particles with a diameter of from 2.00 μm to less than 40.30 μm.

From the weight-average particle diameter (D4) and number-average particle diameter (Dn) of each toner, D4/Dn ratio was calculated to evaluate the particle size distribution for each toner based on the criteria below. The results are shown in Table 1.

-Evaluation of Particle Size Distribution (D4/Dn)-

Evaluation criteria are:

S: D4/Dn value is less than 1.15

A: D4/Dn value is from 1.15 to less than 1.25

B: D4/Dn value is from 1.25 to less than 1.50

C: D4/Dn value is 1.50 or greater

-Preparation of Developer-

Using a HENSCHEL MIXER, 100 parts by mass of each of the obtained 8 toners was mixed with 0.7 part by mass of hydrophobic silica and 0.3 part by mass of hydrophobic titanium oxide. In this way "Developers 1 to 7" were prepared, each of which is consisting of 5% by mass of toner and 95% by mass of silicon resin-coated cupper-zinc ferrite carrier with an average particle diameter of 40 μm.

Note that toners used for Developers 1 to 7 correspond to Toners 1 to 5 and Comparative Toners 1 and 2, respectively.

<Charge Density>

Six grams of each developer was measured into a metallic cylinder and blown off to measure the charge density. Note that the toner concentration was adjusted to 4.5% by mass to 5.5% by mass.

<Comprehensive Evaluation>

By combining the results of the foregoing evaluations, comprehensive evaluations were made on toners based on the following criteria:

A: Good

B: Bad

TABLE 1

| | Ex. 1 | Ex. 2 | Ex. 3 | Ex. 4 | Ex. 5 | Compara. Ex. 1 | Compara. Ex. 2 |
|---|---|---|---|---|---|---|---|
| Weight-average particle diameter (D4) (μm) | 5.6 | 6.8 | 4.8 | 7.9 | 9.8 | 6.83 | 11.5 |
| Number-average particle diameter (Dn) (μm) | 5.3 | 5.5 | 4.2 | 6.5 | 8.2 | 6.04 | 5.5 |
| D4/Dn | 1.06 | 1.24 | 1.14 | 1.22 | 1.20 | 1.13 | 2.09 |
| Particle size distribution | S | A | S | A | A | S | C |
| Image density | A | A | A | A | A | C | B |
| Adhesion of toner to photoconductor | A | A | A | A | A | B | C |
| Charge density (μC/g) | −34 | −31 | −30 | −35 | −27 | −12 | −18 |
| Comprehensive Evaluation | A | A | A | A | A | B | B |

For each of the developers prepared in Examples 1 to 5 and Comparative Examples 1 and 2, image density, occurrence of toner adhesion to the photoconductor, and charge density were determined. The results are listed in Table 1.

<Image Density>

For each developer, a solid image was formed on copy sheets (Type 6000<70W>, Ricoh Company, Ltd.) using Imagio Neo 450 (a tandem color image forming apparatus, Ricoh Company, Ltd.), with the deposited amount of developer being 1.00±0.05 mg/cm$^2$. Formation of solid image was carried out on 8,000 sheets. The image densities of two sheets—the first one and 8,000th one—were determined by visual inspection based on the following criteria. It should be noted that the higher the image density, the higher the density of resultant images. This evaluation corresponds to a working example of the image forming method of the present invention.

Evaluation criteria are:

A: No image density change between the first and 8,000th sheets, both providing high-image quality B: The image density and image quality of the 8,000th sheet is slightly reduced C: The image density and image quality of the 8,000th sheet is significantly reduced <Toner Adhesion>

After image forming, the occurrence of toner adhesion to the organic photoconductor (OPC) was determined by visual inspection, and evaluations were made based on the following criteria:

A: No toner particles on the photoconductor

B: Slight amounts of toner particles on the photoconductor

C: Large amounts of particles on the photoconductor

From the results shown in Table 1, it is established that in contrast to toners of Comparative Examples 1 and 2, toners of Examples 1 to 5, treated with a supercritical fluid, have sharp particle diameter distributions, have excellent charging properties, and can provide high-image densities.

It is also established that toner of Comparative 1 has a low image density because it is less likely to be colored with dyes, but the use of a supercritical fluid allows the dye to explore the inside of the resin particles to provide sufficient coloring and image density.

Toner of Comparative Example 2 is one produced by dissolving a styrene-acrylic resin into a supercritical fluid and allowing toner particles to precipitate. It failed to show a sharp particle size distribution because of its low solubility for the supercritical fluid.

In addition, the toner production process of the present invention entails little generation of waste solution and can provide a dry, polymerized toner just by bringing the reaction cell to normal pressure. Accordingly, this toner production process features low cost and low environmental impacts and requires the minimum amount of energy and resources, making it advantageous over conventional processes.

The toner of the present invention produced by the toner production process of the present invention has a sharp particle diameter distribution and excellent toner characteristics (e.g., charging properties, environmental impact, and temporal stability), is low cost, creates little waste solution, requires no drying process, contains no monomers left over, and features low environmental impact. Thus, the toner of the present invention can be widely used for laser printers, direct digital plate-making systems, full-color copiers using direct- or indirect-electrographic multicolor image developing setup, full-color laser printers, full-color plain paper faxes, etc.

What is claimed is:

1. A toner production process, comprising:

polymerizing at least radically polymerizable monomers in at least one of a supercritical fluid and a subcritical fluid to thereby produce toner particles, wherein a polymer of the radically polymerizable monomers is insoluble in at least one of the supercritical fluid and the subcritical fluid, wherein the at least one of a supercritical fluid and a subcritical fluid contains (1) at least one surfactant selected from the group consisting of fluorine-containing compounds and silicon-containing compounds, and (2) a dispersing agent, and wherein a colorant is present with the monomers during the polymerization.

2. The toner production process according to claim 1, wherein the polymerization is dispersion polymerization of the radically polymerizable monomers, and a polymer resulted from the dispersion polymerization is insoluble in at least one of the supercritical fluid and the subcritical fluid.

3. The toner production process according to claim 1, wherein the polymerization is suspension polymerization of the radically polymerizable monomers, and a polymer resulted from the suspension polymerization is insoluble in at least one of the supercritical fluid and the subcritical fluid.

4. The toner production process according to claim 1, wherein the radically polymerizable monomers are soluble in at least one of the supercritical fluid and the subcritical fluid.

5. The toner production process according to claim 1, wherein at least one of the supercritical fluid and the subcritical fluid contains at least carbon dioxide.

6. The toner production process according to claim 1, wherein the dispersing agent contains one of inorganic particles and organic particles.

7. The toner production process according to claim 1, wherein at least one of the supercritical fluid and the subcritical fluid contains an entrainer.

8. The toner production process according to claim 7, wherein the content of the entrainer is 0.1% by mass to 10% by mass.

9. The toner production process according to claim 7, wherein the entrainer is a poor solvent for toner binder resin at 250° C. and 0.1 MPa.

10. The toner production process according to claim 7, wherein the entrainer is a lower alcohol selected from the group consisting of methanol, ethanol, and propanol.

11. The toner production process according to claim 1, wherein a releasing agent is present with the monomers during the polymerization.

12. A toner produced by a toner production process which comprises:

polymerizing at least radically polymerizable monomers in at least one of a supercritical fluid and a subcritical fluid to thereby produce toner particles, wherein a polymer of the radically polymerizable monomers is insoluble in at least one of the supercritical fluid and the subcritical fluid, wherein the at least one of a supercritical fluid and a subcritical fluid contains (1) at least one surfactant selected from the group consisting of fluorine-containing compounds and silicon-containing compounds, and (2) a dispersing agent, and wherein a colorant is present with the monomers during the polymerization.

13. The toner according to claim 12, wherein the weight-average particle diameter is 3 μm to 10 μm, and the ratio of the weight-average particle diameter to the number-average particle diameter (weight-average particle diameter/number-average particle diameter) is 1.00 to 1.25.

14. An image forming method, comprising:

forming a latent electrostatic image on a latent electrostatic image bearing member;

developing the latent electrostatic image using a toner to form a visible image;

transferring the visible image onto a recording medium; and fixing the transferred visible image transferred to the recording medium, wherein the toner is produced by a toner production process which comprises:

polymerizing at least radically polymerizable monomers in at least one of a supercritical fluid and a subcritical fluid to thereby produce toner particles, wherein a polymer of the radically polymerizable monomers is insoluble in at least one of the supercritical fluid and the subcritical fluid, wherein the at least one of a supercritical fluid and a subcritical fluid contains (1) at least one surfactant selected from the group consisting of fluorine-containing compounds and silicon-containing compounds, and (2) a dispersing agent, and wherein a colorant is present with the monomers during the polymerization.

* * * * *